US010599061B1

(12) United States Patent
Kakehi et al.

(10) Patent No.: US 10,599,061 B1
(45) Date of Patent: Mar. 24, 2020

(54) ELECTROSTATIC-IMAGE DEVELOPING TONER, ELECTROSTATIC-IMAGE DEVELOPER, TONER CARTRIDGE, PROCESS CARTRIDGE, IMAGE FORMING APPARATUS, AND IMAGE FORMING METHOD

(71) Applicant: FUJI XEROX CO., LTD., Tokyo (JP)

(72) Inventors: Soutaro Kakehi, Kanagawa (JP); Yasuko Torii, Kanagawa (JP); Moegi Iguchi, Kanagawa (JP); Sakon Takahashi, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/515,624

(22) Filed: Jul. 18, 2019

(51) Int. Cl.

| | |
|---|---|
| ***G03G 9/08*** | (2006.01) |
| ***G03G 9/097*** | (2006.01) |
| ***G03G 15/08*** | (2006.01) |

(52) U.S. Cl.
CPC ..... *G03G 9/09775* (2013.01); *G03G 9/0819* (2013.01); *G03G 9/09725* (2013.01); *G03G 15/0865* (2013.01)

(58) Field of Classification Search
CPC ..... G03G 9/09775; G03G 9/09725
USPC ..... 430/108.3
See application file for complete search history.

(56) References Cited

FOREIGN PATENT DOCUMENTS

| | | | |
|---|---|---|---|
| JP | 11-038685 | A | 2/1999 |
| JP | 2007-248867 | A | 9/2007 |
| JP | 2016-167029 | A | 9/2016 |

*Primary Examiner* — Mark A Chapman
(74) *Attorney, Agent, or Firm* — Sughrue Mion, PLLC

(57) ABSTRACT

An electrostatic-image developing toner includes toner particles, inorganic particles externally added to the toner particles, and a low-molecular-weight siloxane having a molecular weight of 200 or more and 600 or less. The low-molecular-weight siloxane includes only a siloxane bond and an alkyl group. The total content of the low-molecular-weight siloxane in the electrostatic-image developing toner is, by mass, 0.01 ppm or more and 5 ppm or less.

12 Claims, 2 Drawing Sheets

ELECTROSTATIC-IMAGE DEVELOPING TONER, ELECTROSTATIC-IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2019-055421 filed Mar. 22, 2019.

BACKGROUND

(i) Technical Field

The present disclosure relates to a toner for developing electrostatic images (hereinafter, referred to as "electrostatic-image developing toner"), an electrostatic-image developer, a toner cartridge, a process cartridge, an image forming apparatus, and an image forming method.

(ii) Related Art

Japanese Laid Open Patent Application Publication No. 2016-167029 discloses an electrostatic-image developing toner including toner particles to which silica particles that are surface-treated with a cyclic siloxane and have a carbon content of 5% or more and 10% or less are externally added.

Japanese Laid Open Patent Application Publication No. 2007-248867 discloses an electrophotographic toner including toner particles to which inorganic particles surface-treated with a silicone oil are externally added.

Japanese Laid Open Patent Application Publication No. H11-038685 discloses a toner including silica treated with a titanate coupling agent.

SUMMARY

Aspects of non-limiting embodiments of the present disclosure relate to an electrostatic-image developing toner capable of relatively quickly becoming charged to an intended degree when stirred in a developing apparatus compared with an electrostatic-image developing toner in which the total content of a low-molecular-weight siloxane having a molecular weight of 200 or more and 600 or less is more than 5 ppm or an electrostatic-image developing toner that includes a low-molecular-weight siloxane having a molecular weight of less than 200 or more than 600 instead of a low-molecular-weight siloxane having a molecular weight of 200 or more and 600 or less.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic-image developing toner including toner particles, inorganic particles externally added to the toner particles, and a low-molecular-weight siloxane having a molecular weight of 200 or more and 600 or less. The low-molecular-weight siloxane consists of a siloxane bond and an alkyl group. The total content of the low-molecular-weight siloxane in the electrostatic-image developing toner is, by mass, 0.01 ppm or more and 5 ppm or less.

BRIEF DESCRIPTION OF THE DRAWINGS

Exemplary embodiments of the present disclosure will be described in detail based on the following figures, wherein.

DETAILED DESCRIPTION

Figure 1:
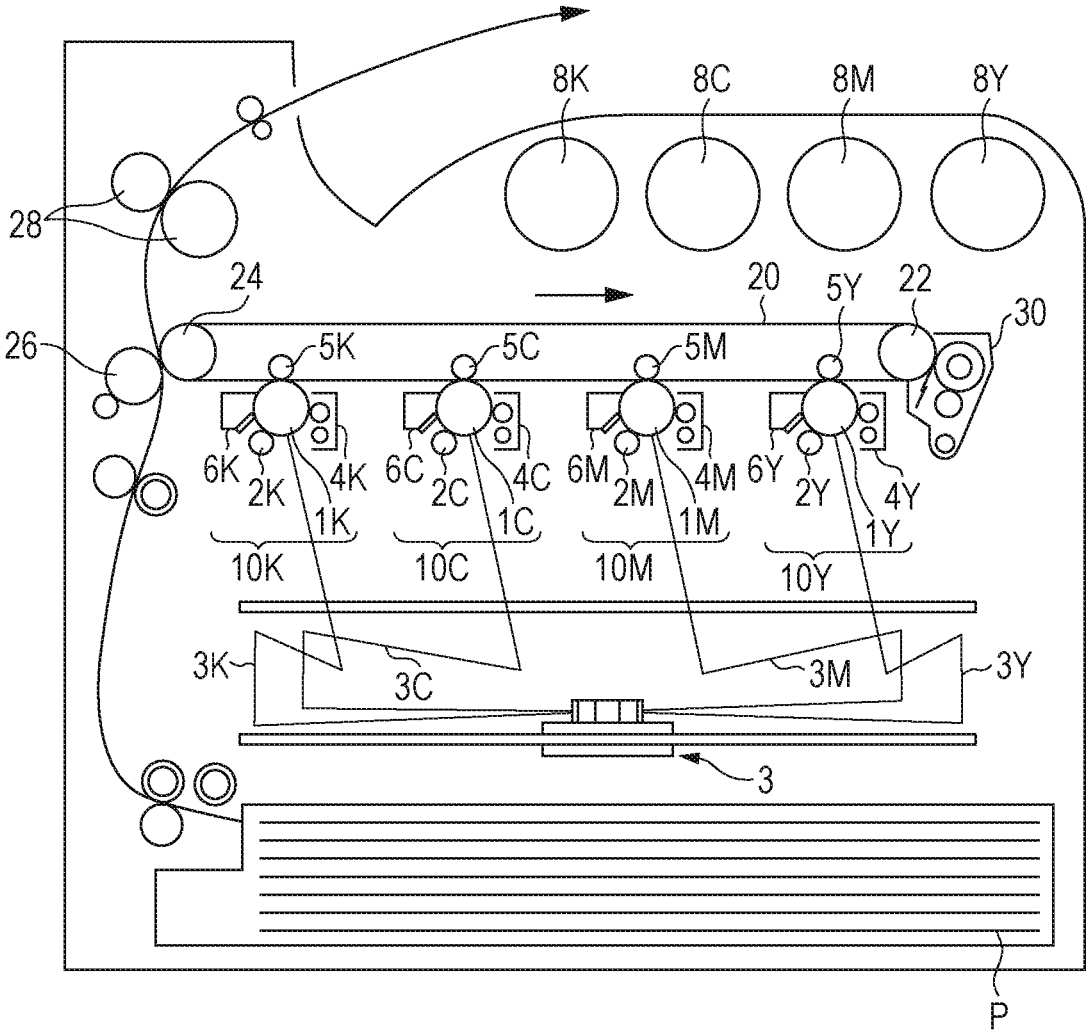
FIG. 1 is a schematic diagram illustrating an example of an image forming apparatus according to an exemplary embodiment.

Exemplary embodiments of the present disclosure are described below. The following description and Examples below are intended to be illustrative of the exemplary embodiments and not restrictive of the scope of the exemplary embodiments.

In the present disclosure, a numerical range expressed using "to" means the range specified by the minimum and maximum described before and after "to", respectively.

In the present disclosure, when numerical ranges are described in a stepwise manner, the upper or lower limit of a numerical range may be replaced with the upper or lower limit of another numerical range, respectively. In the present disclosure, the upper and lower limits of a numerical range may be replaced with the upper and lower limits described in Examples below.

The term "step" used herein refers not only to an individual step but also to a step that is not distinguishable from other steps but achieves the intended purpose of the step.

In the present disclosure, when an exemplary embodiment is described with reference to a drawing, the structure of the exemplary embodiment is not limited to the structure illustrated in the drawing. The sizes of the members illustrated in the attached drawings are conceptual and do not limit the relative relationship among the sizes of the members.

Each of the components described in the present disclosure may include plural types of substances that correspond to the component. In the present disclosure, in the case where a composition includes plural substances that correspond to a component of the composition, the content of the component in the composition is the total content of the plural substances in the composition unless otherwise specified.

In the present disclosure, the number of types of particles that correspond to a component may be two or more. In the case where a composition includes plural types of particles that correspond to a component of the composition, the particle size of the component is the particle size of a mixture of the plural types of particles included in the composition unless otherwise specified.

In the present disclosure, an electrostatic-image developing toner is referred to simply as "toner", and an electrostatic-image developer is referred to simply as "developer".

Electrostatic-Image Developing Toner

The toner according to the exemplary embodiment includes toner particles, inorganic particles externally added to the toner particles, and a low-molecular-weight siloxane having a molecular weight of 200 or more and 600 or less. The low-molecular-weight siloxane consists of a siloxane bond and an alkyl group. The total content of the low-molecular-weight siloxane in the toner is, by mass, 0.01 ppm or more and 5 ppm or less. Note that, "ppm" is the abbreviation for parts per million.

The term "siloxane" used herein refers to a siloxane consisting of a siloxane bond and an alkyl group unless otherwise specified. In the present disclosure, siloxanes having a molecular weight of less than 1,000 are categorized as low-molecular-weight siloxanes, while siloxanes having a molecular weight of 1,000 or more are categorized as silicone oils.

The toner according to the exemplary embodiment is capable of quickly becoming charged to an intended degree when stirred in a developing apparatus. Therefore, by using the toner according to the exemplary embodiment, the occurrence of fog may be reduced soon after the start of the operation. The term "fog" used herein refers to the phenomenon in which a toner adheres to a portion of an image holding member on which an electrostatic image is not formed and, consequently, an unwanted image appears on a recording medium.

In the toner according to the exemplary embodiment, a part or the entirety of the low-molecular-weight siloxane having a molecular weight of 200 or more and 600 or less is deposited on the surfaces of the inorganic particles, which serve as an external additive. It is considered that the low-molecular-weight siloxane having a molecular weight of 200 or more and 600 or less, which is deposited on the surfaces of the inorganic particles, increases the frictional force acting between the inorganic particles and thereby enables the toner to quickly become charged to an intended degree when stirred in a developing apparatus.

If the total content of the low-molecular-weight siloxane having a molecular weight of 200 or more and 600 or less in the toner is less than 0.01 ppm by mass, the intended effects of the low-molecular-weight siloxane may fail to be achieved to a sufficient degree.

If the total content of the low-molecular-weight siloxane having a molecular weight of 200 or more and 600 or less in the toner is more than 5 ppm by mass, the toner may have a relatively small dielectric constant and, consequently, the toner may fail to become charged to an intended degree when stirred in a developing apparatus.

Accordingly, it is considered that the toner is capable of quickly becoming charged to an intended degree when stirred in a developing apparatus in the case where the total content of the low-molecular-weight siloxane having a molecular weight of 200 or more and 600 or less in the toner is low but adequate, that is, 0.01 ppm or more and 5 ppm or less.

In the toner according to the exemplary embodiment, a part or the entirety of the low-molecular-weight siloxane having a molecular weight of 200 or more and 600 or less is deposited on the surfaces of the inorganic particles, which serve as an external additive.

If a low-molecular-weight siloxane having a molecular weight of less than 200 is deposited on the surfaces of the inorganic particles instead of the low-molecular-weight siloxane having a molecular weight of 200 or more and 600 or less, the frictional force acting between the inorganic particles may fail to be increased to a sufficient degree since the kinematic viscosity of the low-molecular-weight siloxane is relatively small and, as a result, such a toner may be less capable of quickly becoming charged to an intended degree when stirred in a developing apparatus than the toner according to the exemplary embodiment.

If a low-molecular-weight siloxane having a molecular weight of more than 600 is deposited on the surfaces of the inorganic particles instead of the low-molecular-weight siloxane having a molecular weight of 200 or more and 600 or less, the dielectric constant of the toner may be relatively reduced since the electrical conductivity of the low-molecular-weight siloxane is relatively small and, as a result, such a toner may be less capable of quickly becoming charged to an intended degree when stirred in a developing apparatus than the toner according to the exemplary embodiment.

The toner according to the exemplary embodiment may include at least one selected from the group consisting of a low-molecular-weight siloxane having a molecular weight of less than 200, a low-molecular-weight siloxane having a molecular weight of more than 600 and less than 1,000, and a silicone oil having a molecular weight of 1,000 or more such that the intended effects of the toner according to the exemplary embodiment are not impaired.

The toner according to the exemplary embodiment is detailed below.

Toner Particles

The toner particles include, for example, a binder resin and may optionally include a colorant, a release agent, and other additives.

Binder Resin

Examples of the binder resin include vinyl resins that are homopolymers of the following monomers or copolymers of two or more monomers selected from the following monomers: styrenes, such as styrene, para-chlorostyrene, and α-methylstyrene; (meth)acrylates, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; ethylenically unsaturated nitriles, such as acrylonitrile and methacrylonitrile; vinyl ethers, such as vinyl methyl ether and vinyl isobutyl ether; vinyl ketones, such as vinyl methyl ketone, vinyl ethyl ketone, and vinyl isopropenyl ketone; and olefins, such as ethylene, propylene, and butadiene.

Examples of the binder resin further include non-vinyl resins, such as epoxy resins, polyester resins, polyurethane resins, polyamide resins, cellulose resins, polyether resins, and modified rosins; a mixture of the non-vinyl resin and the vinyl resin; and a graft polymer produced by polymerization of the vinyl monomer in the presence of the non-vinyl resin.

The above binder resins may be used alone or in combination of two or more.

The binder resin may be a polyester resin.

Examples of the polyester resin include amorphous polyester resins known in the related art. A crystalline polyester resin may be used as a polyester resin in combination with an amorphous polyester resin. In such a case, the content of the crystalline polyester resin in the binder resin may be 2% by mass or more and 40% by mass or less and is preferably 2% by mass or more and 20% by mass or less.

The term "crystalline" resin used herein refers to a resin that, in thermal analysis using differential scanning calorimetry (DSC), exhibits a distinct endothermic peak instead of step-like endothermic change and specifically refers to a resin that exhibits an endothermic peak with a half-width of 10° C. or less at a heating rate of 10° C./min.

On the other hand, the term "amorphous" resin used herein refers to a resin that exhibits an endothermic peak with a half-width of more than 10° C., that exhibits step-like endothermic change, or that does not exhibit a distinct endothermic peak.

Amorphous Polyester Resin

Examples of the amorphous polyester resin include condensation polymers of a polyvalent carboxylic acid and a polyhydric alcohol. The amorphous polyester resin may be a commercially available one or a synthesized one.

Examples of the polyvalent carboxylic acid include aliphatic dicarboxylic acids, such as oxalic acid, malonic acid, maleic acid, fumaric acid, citraconic acid, itaconic acid, glutaconic acid, succinic acid, alkenyl succinic acid, adipic acid, and sebacic acid; alicyclic dicarboxylic acids, such as cyclohexanedicarboxylic acid; aromatic dicarboxylic acids, such as terephthalic acid, isophthalic acid, phthalic acid, and naphthalenedicarboxylic acid; anhydrides of these dicarboxylic acids; and lower (e.g., 1 to 5 carbon atoms) alkyl esters of these dicarboxylic acids. Among these dicarboxylic acids, for example, aromatic dicarboxylic acids may be used as a polyvalent carboxylic acid.

Trivalent or higher carboxylic acids having a crosslinked structure or a branched structure may be used as a polyvalent carboxylic acid in combination with the dicarboxylic acids. Examples of the trivalent or higher carboxylic acids include trimellitic acid, pyromellitic acid, anhydrides of these carboxylic acids, and lower (e.g., 1 to 5 carbon atoms) alkyl esters of these carboxylic acids.

The above polyvalent carboxylic acids may be used alone or in combination of two or more.

Examples of the polyhydric alcohol include aliphatic diols, such as ethylene glycol, diethylene glycol, triethylene glycol, propylene glycol, butanediol, hexanediol, and neopentyl glycol; alicyclic diols, such as cyclohexanediol, cyclohexanedimethanol, and hydrogenated bisphenol A; and aromatic diols, such as bisphenol A-ethylene oxide adduct and bisphenol A-propylene oxide adduct. Among these diols, for example, aromatic diols and alicyclic diols may be used as a polyhydric alcohol. In particular, aromatic diols may be used as a polyhydric alcohol.

Trihydric or higher alcohols having a crosslinked structure or a branched structure may be used as a polyhydric alcohol in combination with the diols. Examples of the trihydric or higher alcohols include glycerin, trimethylolpropane, and pentaerythritol.

The above polyhydric alcohols may be used alone or in combination of two or more.

The glass transition temperature Tg of the amorphous polyester resin is preferably 50° C. or more and 80° C. or less and is more preferably 50° C. or more and 65° C. or less.

The glass transition temperature is determined from a DSC curve obtained by differential scanning calorimetry (DSC). More specifically, the glass transition temperature is determined from the "extrapolated glass-transition-starting temperature" according to a method for determining glass transition temperature which is described in JIS K 7121: 1987 "Testing Methods for Transition Temperatures of Plastics".

The weight-average molecular weight Mw of the amorphous polyester resin is preferably 5,000 or more and 1,000,000 or less and is more preferably 7,000 or more and 500,000 or less.

The number-average molecular weight Mn of the amorphous polyester resin is preferably 2,000 or more and 100,000 or less.

The molecular weight distribution index Mw/Mn of the amorphous polyester resin is preferably 1.5 or more and 100 or less and is more preferably 2 or more and 60 or less.

The weight-average molecular weight and number-average molecular weight of the amorphous polyester resin are determined by gel permeation chromatography (GPC). Specifically, the molecular weights of the amorphous polyester resin are determined by GPC using a "HLC-8120GPC" produced by Tosoh Corporation as measuring equipment, a column "TSKgel SuperHM-M (15 cm)" produced by Tosoh Corporation, and a tetrahydrofuran (THF) solvent. The weight-average molecular weight and number-average molecular weight of the amorphous polyester resin are determined on the basis of the results of the measurement using a molecular-weight calibration curve based on monodisperse polystyrene standard samples.

The amorphous polyester resin may be produced by any suitable production method known in the related art. Specifically, the amorphous polyester resin may be produced by, for example, a method in which polymerization is performed at 180° C. or more and 230° C. or less and the pressure inside the reaction system is reduced as needed while water and alcohols that are generated by condensation are removed.

In the case where the raw materials, that is, the monomers, are not dissolved in or compatible with each other at the reaction temperature, a solvent having a high boiling point may be used as a dissolution adjuvant in order to dissolve the raw materials. In such a case, the condensation polymerization reaction is performed while the dissolution adjuvant is distilled away. In the case where monomers used for copolymerization have low compatibility with each other, a condensation reaction of the monomers with an acid or alcohol that is to undergo a polycondensation reaction with the monomers may be performed in advance and subsequently polycondensation of the resulting polymers with the other components may be performed.

Crystalline Polyester Resin

Examples of the crystalline polyester resin include condensation polymers of a polyvalent carboxylic acid and a polyhydric alcohol. The crystalline polyester resin may be commercially available one or a synthesized one.

In order to increase ease of forming a crystal structure, a condensation polymer prepared from linear aliphatic polymerizable monomers may be used as a crystalline polyester resin instead of a condensation polymer prepared from polymerizable monomers including an aromatic ring.

Examples of the polyvalent carboxylic acid include aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids, such as dibasic acids (e.g., phthalic acid, isophthalic acid, terephthalic acid, and naphthalene-2,6-dicarboxylic acid); anhydrides of these dicarboxylic acids; and lower (e.g., 1 to 5 carbon atoms) alkyl esters of these dicarboxylic acids.

Trivalent or higher carboxylic acids having a crosslinked structure or a branched structure may be used as a polyvalent carboxylic acid in combination with the dicarboxylic acids. Examples of the trivalent carboxylic acids include aromatic carboxylic acids, such as 1,2,3-benzenetricarboxylic acid, 1,2,4-benzenetricarboxylic acid, and 1,2,4-naphthalenetricarboxylic acid; anhydrides of these tricarboxylic acids; and lower (e.g., 1 to 5 carbon atoms) alkyl esters of these tricarboxylic acids.

Dicarboxylic acids including a sulfonic group and dicarboxylic acids including an ethylenic double bond may be used as a polyvalent carboxylic acid in combination with the above dicarboxylic acids.

The above polyvalent carboxylic acids may be used alone or in combination of two or more.

Examples of the polyhydric alcohol include aliphatic diols, such as linear aliphatic diols including a backbone having 7 to 20 carbon atoms. Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol may be used.

Trihydric or higher alcohols having a crosslinked structure or a branched structure may be used as a polyhydric alcohol in combination with the above diols. Examples of the trihydric or higher alcohols include glycerin, trimethylolethane, trimethylolpropane, and pentaerythritol.

The above polyhydric alcohols may be used alone or in combination of two or more.

The content of the aliphatic diols in the polyhydric alcohol may be 80 mol % or more and is preferably 90 mol % or more.

The melting temperature of the crystalline polyester resin is preferably 50° C. or more and 100° C. or less, is more preferably 55° C. or more and 90° C. or less, and is further preferably 60° C. or more and 85° C. or less.

The melting temperature of the crystalline polyester resin is determined from the "melting peak temperature" according to a method for determining melting temperature which is described in JIS K 7121:1987 "Testing Methods for Transition Temperatures of Plastics" using a DSC curve obtained by differential scanning calorimetry (DSC).

The crystalline polyester resin may have a weight-average molecular weight Mw of 6,000 or more and 35,000 or less.

The crystalline polyester resin may be produced by any suitable method known in the related art similarly to the amorphous polyester resin.

The content of the binder resin in the toner particles is preferably 40% by mass or more and 95% by mass or less, is more preferably 50% by mass or more and 90% by mass or less, and is further preferably 60% by mass or more and 85% by mass or less.

Colorant

Examples of the colorant include pigments such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The above colorants may be used alone or in combination of two or more.

The colorant may optionally be subjected to a surface treatment and may be used in combination with a dispersant. Plural types of colorants may be used in combination.

The content of the colorant in the toner particles is preferably 1% by mass or more and 30% by mass or less and is more preferably 3% by mass or more and 15% by mass or less.

Release Agent

Examples of the release agent include, but are not limited to, hydrocarbon waxes; natural waxes, such as a carnauba wax, a rice bran wax, and a candelilla wax; synthetic or mineral-petroleum-derived waxes, such as a montan wax; and ester waxes, such as a fatty-acid ester wax and a montanate wax.

The melting temperature of the release agent is preferably 50° C. or more and 110° C. or less and is more preferably 60° C. or more and 100° C. or less. The melting temperature of the release agent is determined from the "melting peak temperature" according to a method for determining melting temperature which is described in JIS K 7121:1987 "Testing Methods for Transition Temperatures of Plastics" using a DSC curve obtained by differential scanning calorimetry (DSC).

The content of the release agent in the toner particles is preferably 1% by mass or more and 20% by mass or less and is more preferably 5% by mass or more and 15% by mass or less.

Other Additives

Examples of the other additives include additives known in the related art, such as a magnetic substance, a charge-controlling agent, and an inorganic powder. These additives may be added to the toner particles as internal additives.

Properties, Etc. Of Toner Particles

The toner particles may have a single-layer structure or a "core-shell" structure constituted by a core (i.e., core particle) and a coating layer (i.e., shell layer) covering the core. The core-shell structure of the toner particles may be constituted by, for example, a core including a binder resin and, as needed, other additives such as a colorant and a release agent and by a coating layer including the binder resin.

The volume-average diameter D50v of the toner particles is preferably 2 μm or more and 10 μm or less and is more preferably 4 μm or more and 8 μm or less.

The above-described average diameters and particle diameter distribution indices of the toner particles are measured using "COULTER Multisizer II" (produced by Beckman Coulter, Inc.) with an electrolyte "ISOTON-II" (produced by Beckman Coulter, Inc.) in the following manner.

A sample to be measured (0.5 mg or more and 50 mg or less) is added to 2 ml of a 5 mass %-aqueous solution of a surfactant (e.g., sodium alkylbenzene sulfonate) that serves as a dispersant. The resulting mixture is added to 100 ml or more and 150 ml or less of an electrolyte.

The resulting electrolyte containing the sample suspended therein is subjected to a dispersion treatment for 1 minute using an ultrasonic disperser, and the distribution of the diameters of particles having a diameter of 2 μm or more and 60 μm or less is measured using COULTER Multisizer II with an aperture having a diameter of 100 μm. The number of the particles sampled is 50,000.

The particle diameter distribution measured is divided into a number of particle diameter ranges (i.e., channels). For each range, in ascending order in terms of particle diameter, the cumulative volume and the cumulative number are calculated and plotted to draw cumulative distribution curves. Particle diameters at which the cumulative volume and the cumulative number reach 16% are considered to be the volume particle diameter D16v and the number particle diameter D16p, respectively. Particle diameters at which the cumulative volume and the cumulative number reach 50% are considered to be the volume-average particle diameter D50v and the number-average particle diameter D50p, respectively. Particle diameters at which the cumulative volume and the cumulative number reach 84% are considered to be the volume particle diameter D84v and the number particle diameter D84p, respectively.

Using the volume particle diameters and number particle diameters measured, the volume particle diameter distribution index (GSDv) is calculated as $(D84v/D16v)^{1/2}$ and the number particle diameter distribution index (GSDp) is calculated as $(D84p/D16p)^{1/2}$.

The toner particles preferably has an average circularity of 0.94 or more and 1.00 or less. The average circularity of the toner particles is more preferably 0.95 or more and 0.98 or less.

The average circularity of the toner particles is determined as [Equivalent circle perimeter]/[Perimeter] (i.e., [Perimeter of a circle having the same projection area as the particles]/[Perimeter of the projection image of the particles]. Specifically, the average circularity of the toner particles is determined by the following method.

The toner particles to be measured are sampled by suction so as to form a flat stream. A static image of the particles is taken by instantaneously flashing a strobe light. The image of the particles is analyzed with a flow particle image analyzer "FPIA-3000" produced by Sysmex Corporation. The number of samples used for determining the average circularity of the toner particles is 3500.

In the case where the toner includes an external additive, the toner (i.e., the developer) to be measured is dispersed in water containing a surfactant and then subjected to an ultrasonic wave treatment in order to remove the external additive from the toner particles.

External Additive

The toner according to the exemplary embodiment includes inorganic particles that serve as an external additive. Examples of the inorganic particles include $SiO_2$ particles, $TiO_2$ particles, $Al_2O_3$ particles, CuO particles, ZnO particles, $SnO_2$ particles, $CeO_2$ particles, $Fe_2O_3$ particles, MgO particles, BaO particles, CaO particles, $K_2O$ particles, $Na_2O$ particles, $ZrO_2$ particles, $CaO{\cdot}SiO_2$ particles, $K_2O{\cdot}(TiO_2)_n$ particles, $Al_2O_3{\cdot}2SiO_2$ particles, $CaCO_3$ particles, $MgCO_3$ particles, $BaSO_4$ particles, and $MgSO_4$ particles.

The surfaces of the inorganic particles used as the external additive may be subjected to a hydrophobic treatment. The hydrophobic treatment may be performed by, for example, immersing the inorganic particles in a hydrophobizing agent. Examples of the hydrophobizing agent include, but are not limited to, a silane coupling agent, silicone oil, a titanate coupling agent, and aluminium coupling agent. These hydrophobizing agents may be used alone or in combination of two or more.

The amount of the hydrophobizing agent may be 1 part by mass or more and 10 parts by mass or less relative to 100 parts by mass of the inorganic particles.

In the exemplary embodiment, a low-molecular-weight siloxane having a molecular weight of 200 or more and 600 or less may be deposited on a part or the entirety of the externally added inorganic particles.

In the case where the inorganic particles are hydrophobic inorganic particles that have been subjected to a hydrophobic surface treatment, the low-molecular-weight siloxane having a molecular weight of 200 or more and 600 or less may be deposited on the hydrophobized surfaces of the inorganic particles.

The toner according to the exemplary embodiment may further include external additive particles other than the inorganic particles. Examples of the external additive particles other than the inorganic particles include particles of a resin, such as polystyrene, polymethyl methacrylate, or a melamine resin; and particles of a cleaning lubricant, such as a metal salt of a higher fatty acid, such as zinc stearate, or a fluorine-based high-molecular-weight compound.

The amount of the external additive deposited on the toner particles is preferably 0.01% by mass or more and 5% by mass or less and is more preferably 0.01% by mass or more and 2.0% by mass or less of the amount of the toner particles.

Sol-Gel Silica Particles

The external additive may be sol-gel silica particles. In the case where the sol-gel silica particles contain an adequate amount of water, toner particles to which the sol-gel silica particles are externally added may be quickly become charged to an intended degree when stirred in a developing apparatus.

The content of water in the sol-gel silica particles can be determined on the basis of a reduction in the mass of the sol-gel silica particles which occurs when the sol-gel silica particles are heated. A reduction in the mass of the sol-gel silica particles which occurs when the sol-gel silica particles are heated from 30° C. to 250° C. at a rate of 30° C./min may be 1% by mass or more and 10% by mass or less.

When the above mass reduction is 1% by mass or more, the flow of the sol-gel silica particles on the surfaces of the toner particles is limited and the sol-gel silica particles keep being dispersed with high uniformity on the surfaces of the toner particles. This enables the toner to quickly become charged to an intended degree when stirred in a developing apparatus. In this regard, the mass reduction is more preferably 2% by mass or more and is further preferably 3% by mass or more.

When the above mass reduction is 10% by mass or less, leakage of electric charge through the sol-gel silica particles is limited. This enables the toner to quickly become charged to an intended degree when stirred in a developing apparatus. In this regard, the mass reduction is more preferably 9% by mass or less and is further preferably 8% by mass or less.

In the exemplary embodiment, the reduction in the mass of the sol-gel silica particles which occurs when the sol-gel silica particles are heated is determined by the following measuring method.

About 30 mg of the sol-gel silica particles are charged into a sample chamber of a thermogravimetric analyzer "DTG-60AH" produced by Shimadzu Corporation. The temperature is increased from 30° C. to 250° C. at a rate of 30° C./min. The mass reduction is calculated from the difference between the mass of the heated sample and the initial mass of the sample.

The sample subjected to the thermogravimetric analyzer is sol-gel silica particles that are to be used as a material for the toner or sol-gel silica particles separated from the toner. The method for separating the sol-gel silica particles from the toner is not limited. For example, the toner is dispersed in water containing a surfactant. To the resulting dispersion liquid, an ultrasonic wave is applied. Subsequently, the dispersion liquid is subjected to high-speed centrifugation. The resulting supernatant liquid is dried at normal temperature (23° C.±2° C.) to form sol-gel silica particles.

In the case where sol-gel silica particles that have been subjected to a hydrophobic treatment are used as an external additive, the above measurement is conducted using the hydrophobized sol-gel silica particles as a sample.

The average primary particle size of the sol-gel silica particles is preferably 20 nm or more and 90 nm or less.

When the average primary particle size of the sol-gel silica particles is 20 nm or more, the likelihood of the sol-gel silica particles being buried in the toner particles is low. In this regard, the average primary particle size of the sol-gel silica particles is more preferably 25 nm or more and is further preferably 30 nm or more.

When the average primary particle size of the sol-gel silica particles is 90 nm or less, the likelihood of the sol-gel silica particles remaining on the surfaces of the toner particles is high. In this regard, the average primary particle size of the sol-gel silica particles is more preferably 85 nm or less and is further preferably 80 nm or less.

In the exemplary embodiment, the primary particle size of a sol-gel silica particle is the diameter of a circle having the same area as the primary particle image (i.e., equivalent circle diameter) and is determined by capturing an electron microscope image of the toner to which the sol-gel silica particles are externally added and analyzing at least 300 sol-gel silica particles deposited on the toner particles on the basis of the image. The average primary particle size of the sol-gel silica particles is the particle size at which the cumulative number calculated from the number-basis primary particle size distribution in ascending order in terms of particle diameter reaches 50%.

The sol-gel silica particles may be produced by, for example, the following method.

Tetraalkoxysilane is added dropwise to an alkali catalyst solution containing an alcohol compound and ammonia water in order to cause hydrolysis and condensation of tetraalkoxysilane. Hereby, a suspension containing sol-gel silica particles is formed. Subsequently, the solvent is removed from the suspension to obtain a particulate substance. The particulate substance is dried to form sol-gel silica particles. The average primary particle size of the sol-gel silica particles can be controlled by adjusting the ratio of the amount of the tetraalkoxysilane added to the alkali catalyst solution to the amount of the alkali catalyst solution used. The content of water in the sol-gel silica particles, that is, the reduction in the mass of the sol-gel silica particles which occurs when the sol-gel silica particles are heated from 30° C. to 250° C. at a rate of 30° C./min, can be controlled by adjusting the conditions under which the particulate substance is dried.

The sol-gel silica particles may be hydrophobic sol-gel silica particles that have been subjected to a hydrophobic surface treatment. The hydrophobizing agent used in the hydrophobic surface treatment may be, but is not limited to, a silicon-containing organic compound. Examples of the silicon-containing organic compound include an alkoxysilane compound, a silazane compound, and a silicone oil. The above silicon-containing organic compounds may be used alone or in combination of two or more.

The hydrophobizing agent used for treating the sol-gel silica particles is preferably a silazane compound, such as dimethyldisilazane, trimethyldisilazane, tetramethyldisilazane, pentamethyldisilazane, or hexamethyldisilazane, and is particularly preferably 1,1,1,3,3,3-hexamethyldisilazane (HMDS).

Even in the case where the sol-gel silica particles are hydrophobic sol-gel silica particles that have been subjected to a hydrophobic surface treatment, the reduction in the mass of the sol-gel silica particles which occurs when the sol-gel silica particles are heated may fall within the above-described range, and the average primary particle size of the sol-gel silica particles may fall within the above-described range.

In the case where the sol-gel silica particles are hydrophobic sol-gel silica particles that have been subjected to a hydrophobic surface treatment, the low-molecular-weight siloxane having a molecular weight of 200 or more and 600 or less may be deposited on the hydrophobized surfaces of the sol-gel silica particles.

The BET specific surface area of the sol-gel silica particles and the BET specific surface area of the hydrophobic sol-gel silica particles that have been subjected to a hydrophobic surface treatment are preferably 100 $m^2/g$ or more and 240 $m^2/g$ or less, are more preferably 120 $m^2/g$ or more and 220 $m^2/g$ or less, and are further preferably 150 $m^2/g$ or more and 200 $m^2/g$ or less.

The BET specific surface area of the sol-gel silica particles (including the hydrophobic sol-gel silica particles that have been subjected to a hydrophobic surface treatment) is measured by a BET multipoint method in which a nitrogen gas is used.

The sample subjected to the measurement is sol-gel silica particles that are to be used as a material for the toner or sol-gel silica particles separated from the toner. The method for separating the sol-gel silica particles from the toner is not limited. For example, the toner is dispersed in water containing a surfactant. To the resulting dispersion liquid, an ultrasonic wave is applied. Subsequently, the dispersion liquid is subjected to high-speed centrifugation. The resulting supernatant liquid is dried at normal temperature (23° C.±2° C.) to form sol-gel silica particles.

The amount of the sol-gel silica particles externally added to the toner particles is preferably 0.01% by mass or more and 10% by mass or less, is more preferably 0.05% by mass or more and 5% by mass or less, and is further preferably 0.1% by mass or more and 1% by mass or less of the amount of the toner particles.

Low-Molecular-Weight Siloxane Having Molecular Weight of 200 or More and 600 or Less A part or the entirety of the low-molecular-weight siloxane having a molecular weight of 200 or more and 600 or less may be deposited on a part or the entirety of the inorganic particles that serve as an external additive.

The molecular weight of the low-molecular-weight siloxane may be 200 or more, is preferably 250 or more, is more preferably 280 or more, and is further preferably 300 or more in order to set the kinematic viscosity of the low-molecular-weight siloxane to be relatively high and thereby increase the frictional force acting between the inorganic particles.

The molecular weight of the low-molecular-weight siloxane may be 600 or less, is preferably 550 or less, is more preferably 500 or less, and is further preferably 450 or less in order to set the electrical conductivity of the low-molecular-weight siloxane to be relatively high and thereby set the dielectric constant of the toner to be relatively large.

The number of Si atoms included in a molecule of the low-molecular-weight siloxane having a molecular weight of 200 or more and 600 or less is at least two.

The number of Si atoms included in a molecule of the low-molecular-weight siloxane having a molecular weight of 200 or more and 600 or less is preferably 3 or more, is more preferably 4 or more, and is further preferably 5 or more in order to set the kinematic viscosity of the low-molecular-weight siloxane to be relatively high and thereby increase the frictional force acting between the inorganic particles.

The number of Si atoms included in a molecule of the low-molecular-weight siloxane having a molecular weight of 200 or more and 600 or less is preferably 7 or less, is more preferably 6 or less, and is further preferably 5 or less in order to set the electrical conductivity of the low-molecular-weight siloxane to be relatively high and thereby set the dielectric constant of the toner to be relatively large.

In consideration of the above two points, the number of Si atoms included in a molecule of the low-molecular-weight siloxane having a molecular weight of 200 or more and 600 or less is particularly preferably 5.

The kinematic viscosity of the low-molecular-weight siloxane having a molecular weight of 200 or more and 600 or less at 25° C. may be 2 $mm^2/s$ or more and 5 $mm^2/s$ or less in order to increase the frictional force acting between the inorganic particles to an adequate degree.

In the exemplary embodiment, the kinematic viscosity ($mm^2/s$) of a siloxane is determined by dividing the viscosity of the siloxane at 25° C. which is measured with an Ostwald viscometer (a type of a capillary viscometer) by the density of the siloxane.

An example of the low-molecular-weight siloxane having a molecular weight of 200 or more and 600 or less is a linear siloxane that includes a siloxane bond that is not branched.

Examples of a linear low-molecular-weight siloxane having a molecular weight of 200 or more and 600 or less include hexaalkyldisiloxane, octaalkyltrisiloxane, decaalkyltetrasiloxane, dodecaalkylpentasiloxane, tetradecaalkylhexasiloxane, and hexadecaalkylheptasiloxane (note that, the above siloxanes have a molecular weight of 200 or more and 600 or less).

Examples of the alkyl group included in the above linear low-molecular-weight siloxanes include a linear alkyl group having 1 to 10 carbon atoms (preferably having 1 to 6 carbon atoms, more preferably having 1 to 3 carbon atoms, and further preferably having 1 or 2 carbon atoms); a branched alkyl group having 3 to 10 carbon atoms (preferably having 3 to 6 carbon atoms and more preferably having 3 or 4 carbon atoms); and a cyclic alkyl group having 3 to 10 carbon atoms (preferably having 3 to 6 carbon atoms and more preferably having 3 or 4 carbon atoms). Among these, an alkyl group having 1 to 3 carbon atoms is preferable, at least one of a methyl group and an ethyl group is more preferable, and a methyl group is further preferable. The plural alkyl groups included in a molecule of the linear low-molecular-weight siloxane may be identical to or different from one another.

Specific examples of the linear low-molecular-weight siloxane having a molecular weight of 200 or more and 600 or less include octamethyltrisiloxane, decamethyltetrasiloxane, dodecamethylpentasiloxane, tetradecamethylhexasiloxane, and hexadecamethylheptasiloxane.

An example of the low-molecular-weight siloxane having a molecular weight of 200 or more and 600 or less is a branched siloxane that includes a branched siloxane bond.

Examples of a branched low-molecular-weight siloxane having a molecular weight of 200 or more and 600 or less include branched siloxanes such as 1,1,1,3,5,5,5-heptaalkyl-3-(trialkylsiloxy)trisiloxane, tetrakis(trialkylsiloxy)silane, and 1,1,1,3,5,5,7,7,7-nonaalkyl-3-(trialkylsiloxy)tetrasiloxane (note that, the above siloxanes have a molecular weight of 200 or more and 600 or less).

Examples of the alkyl group included in the above branched low-molecular-weight siloxanes include a linear alkyl group having 1 to 10 carbon atoms (preferably having 1 to 6 carbon atoms, more preferably having 1 to 3 carbon atoms, and further preferably having 1 or 2 carbon atoms); a branched alkyl group having 3 to 10 carbon atoms (preferably having 3 to 6 carbon atoms and more preferably having 3 or 4 carbon atoms); and a cyclic alkyl group having 3 to 10 carbon atoms (preferably having 3 to 6 carbon atoms and more preferably having 3 or 4 carbon atoms). Among these, an alkyl group having 1 to 3 carbon atoms is preferable, at least one of a methyl group and an ethyl group is more preferable, and a methyl group is further preferable. The plural alkyl groups included in a molecule of the branched low-molecular-weight siloxane may be identical to or different from one another.

Specific examples of the branched low-molecular-weight siloxane having a molecular weight of 200 or more and 600 or less include methyltris(trimethylsiloxy)silane (molecular formula: $C_{10}H_{30}O_3Si_4$), tetrakis (trimethylsiloxy) silane (molecular formula: $C_{12}H_{36}O_4Si_5$), and 1,1,1,3,5,5,7,7,7-nonamethyl-3-(trimethylsiloxy)tetrasiloxane (molecular formula: $C_{12}H_{36}O_4Si_5$).

An example of the low-molecular-weight siloxane having a molecular weight of 200 or more and 600 or less is a cyclic siloxane that includes a ring structure consisting of a siloxane bond.

Examples of a cyclic low-molecular-weight siloxane having a molecular weight of 200 or more and 600 or less include hexaalkylcyclotrisiloxane, octaalkylcyclotetrasiloxane, decaalkylcyclopentasiloxane, dodecaalkylcyclohexasiloxane, tetradecaalkylcycloheptasiloxane, and hexadecaalkylcyclooctasiloxane (note that, the above siloxanes have a molecular weight of 200 or more and 600 or less).

Examples of the alkyl group included in the above cyclic low-molecular-weight siloxanes include a linear alkyl group having 1 to 10 carbon atoms (preferably having 1 to 6 carbon atoms, more preferably having 1 to 3 carbon atoms, and further preferably having 1 or 2 carbon atoms); a branched alkyl group having 3 to 10 carbon atoms (preferably having 3 to 6 carbon atoms and more preferably having 3 or 4 carbon atoms); and a cyclic alkyl group having 3 to 10 carbon atoms (preferably having 3 to 6 carbon atoms and more preferably having 3 or 4 carbon atoms). Among these, an alkyl group having 1 to 3 carbon atoms is preferable, at least one of a methyl group and an ethyl group is more preferable, and a methyl group is further preferable. The plural alkyl groups included in a molecule of the cyclic low-molecular-weight siloxane may be identical to or different from one another.

Specific examples of the cyclic low-molecular-weight siloxane having a molecular weight of 200 or more and 600 or less include hexamethylcyclotrisiloxane, octamethylcyclotetrasiloxane, decamethylcyclopentasiloxane, dodecamethylcyclohexasiloxane, tetradecamethylcycloheptasiloxane, and hexadecamethylcyclooctasiloxane.

The low-molecular-weight siloxane having a molecular weight of 200 or more and 600 or less is preferably at least one selected from the group consisting of the linear low-molecular-weight siloxane and the branched low-molecular-weight siloxane, is more preferably the branched low-molecular-weight siloxane, and is further preferably a low-molecular-weight siloxane having a tetrakis structure in order to quickly charge the toner including the low-molecular-weight siloxane to an intended degree by stirring the toner in a developing apparatus. The term "siloxane having a tetrakis structure" used herein refers to a siloxane including at least one structure represented by the following formula (i.e., a tetrakissiloxysilane structure) per molecule.

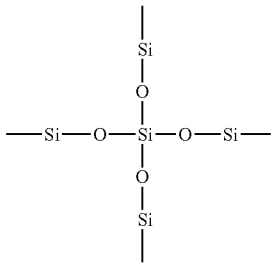

An example of the low-molecular-weight siloxane having a molecular weight of 200 or more and 600 or less and including a tetrakis structure is tetrakis(trialkylsiloxy)silane. Examples of the alkyl group included in the low-molecular-weight siloxane having a tetrakis structure include a linear alkyl group having 1 to 10 carbon atoms (preferably having 1 to 6 carbon atoms, more preferably having 1 to 3 carbon atoms, and further preferably having 1 or 2 carbon atoms); a branched alkyl group having 3 to 10 carbon atoms (preferably having 3 to 6 carbon atoms and more preferably having 3 or 4 carbon atoms); and a cyclic alkyl group having 3 to 10 carbon atoms (preferably having 3 to 6 carbon atoms and more preferably having 3 or 4 carbon atoms). Among these, an alkyl group having 1 to 3 carbon atoms is preferable, at least one of a methyl group and an ethyl group is more preferable, and a methyl group is further preferable. The alkyl groups included in a molecule of the low-molecular-weight siloxane having a tetrakis structure may be identical to or different from one another.

The low-molecular-weight siloxane having a molecular weight of 200 or more and 600 or less is particularly preferably tetrakis(trimethylsiloxy)silane in order to quickly charge the toner including the low-molecular-weight siloxane to an intended degree by stirring the toner in a developing apparatus.

The total amount of the low-molecular-weight siloxane having a molecular weight of 200 or more and 600 or less included in the toner is, by mass, 0.01 ppm or more, is preferably 0.05 ppm or more, and is more preferably 0.1 ppm or more of the amount of the toner in order to increase the frictional force acting between the inorganic particles.

The total amount of the low-molecular-weight siloxane having a molecular weight of 200 or more and 600 or less included in the toner is, by mass, 5 ppm or less, is preferably 1 ppm or less, and is more preferably 0.5 ppm or less of the amount of the toner in order not to reduce the dielectric constant of the toner.

The total amount of the low-molecular-weight siloxane having a molecular weight of 200 or more and 600 or less included in the toner is measured by a headspace method with a gas chromatograph mass spectrometer "GCMS-QP2020" produced by Shimadzu Corporation and a nonpolar column "Rtx-1, 10157" produced by Restek (thickness: 1.00 μm, length: 60 m, inside diameter: 0.32 mm). The specific measuring method is as described below.

The toner is charged into a vial. The vial is sealed with a cap and heated to 190° C. over 3 minutes. Subsequently, the volatile component inside the vial is introduced to the column. The low-molecular-weight siloxane having a molecular weight of 200 or more and 600 or less is detected under the following conditions.

Carriers gas type: Helium

Carriers gas pressure: 120 kPa (constant pressure)

Oven temperature: 40° C. (5 minutes)→(15° C./min)→250° C. (6 minutes) (25 minutes in total)

Ion source temperature: 260° C.

Interface temperature: 260° C.

A calibration curve is prepared using reference solutions having different concentrations which are prepared by diluting a reference substance (tetrakis(trimethylsiloxy)silane1) with ethanol. The content of the low-molecular-weight siloxane is determined on the basis of the area of the peak corresponding to the low-molecular-weight siloxane having a molecular weight of 200 or more and 600 or less which occurs in the chromatograph of the sample and the calibration curve of the reference substance. In the case where plural peaks corresponding to the low-molecular-weight siloxane having a molecular weight of 200 or more and 600 or less occur in the chromatograph of the sample, the content of the low-molecular-weight siloxane is determined on the basis of the total area of the peaks and the calibration curve of the reference substance. Furthermore, the ratio (ppm) of the total amount of the low-molecular-weight siloxane having a molecular weight of 200 or more and 600 or less included in the toner to the total amount of the toner is calculated.

The total amount of the low-molecular-weight siloxane having a molecular weight of 200 or more and 600 or less included in the toner is preferably 1 ppm or more, is more preferably 5 ppm or more, is further preferably 10 ppm or more, is particularly preferably 15 ppm or more, and is most preferably 20 ppm or more of the total amount of the inorganic particles included in the toner in order to increase the frictional force acting between the inorganic particles.

The total amount of the low-molecular-weight siloxane having a molecular weight of 200 or more and 600 or less included in the toner is preferably 1,000 ppm or less, is more preferably 500 ppm or less, is further preferably 200 ppm or less, is particularly preferably 100 ppm or less, and is most preferably 50 ppm or less of the total amount of the inorganic particles included in the toner in order not to reduce the dielectric constant of the toner.

The above mass proportion is calculated by converting [Total amount of low-molecular-weight siloxane having molecular weight of 200 or more and 600 or less included in toner]/[Total amount of inorganic particles included in toner] into parts per million.

In the case where the inorganic particles are hydrophobic inorganic particles that have been subjected to a hydrophobic treatment, the mass of the inorganic particles is the mass of the hydrophobic inorganic particles, that is, includes the mass of the component derived from the hydrophobizing agent used for the hydrophobic treatment.

The total amount of the inorganic particles included in the toner is determined by the following measuring method.

The toner is dispersed in water containing a surfactant. To the resulting dispersion liquid, an ultrasonic wave is applied. Subsequently, the dispersion liquid is subjected to high-speed centrifugation. The resulting supernatant liquid is dried at normal temperature (23° C.±2° C.) to obtain inorganic particles. The inorganic particles separated from the supernatant are weighed. Although the low-molecular-weight siloxane may be deposited on the surfaces of the inorganic particles separated from the supernatant, the low-molecular-weight siloxane deposited on the surfaces of the inorganic particles is negligible because the mass of such a low-molecular-weight siloxane is negligibly smaller than the mass of the inorganic particles.

The low-molecular-weight siloxane having a molecular weight of 200 or more and 600 or less may be added to the toner by, for example, being externally adding to the toner particle; or by being used as a surface-treating agent for the inorganic particles (i.e., specifically, the sol-gel silica particles) that serves as an external additive.

Method for Producing Toner

The toner according to the exemplary embodiment is produced by, after the preparation of the toner particles, depositing an external additive on the surfaces of the toner particles.

The toner particles may be prepared by any dry process, such as knead pulverization, or any wet process, such as aggregation coalescence, suspension polymerization, or dissolution suspension. However, a method for preparing the toner particles is not limited thereto, and any suitable method known in the related art may be used. Among these methods, aggregation coalescence may be used in order to prepare the toner particles.

Specifically, in the case where, for example, aggregation coalescence is used in order to prepare the toner particles, the toner particles are prepared by the following steps:

preparing a resin particle dispersion liquid in which resin particles serving as a binder resin are dispersed (i.e., resin particle dispersion liquid preparation step);

causing the resin particles (and, as needed, other particles) to aggregate together in the resin particle dispersion liquid (or in the resin particle dispersion liquid mixed with another particle dispersion liquid as needed) in order to form aggregated particles (i.e., aggregated particle formation step);

and heating the resulting aggregated particle dispersion liquid in which the aggregated particles are dispersed in order to cause fusion and coalescence of the aggregated particles to occur and thereby form toner particles (fusion-coalescence step).

Each of the above steps is described below in detail. Hereinafter, a method for preparing toner particles including a colorant and a release agent is described. However, it should be noted that the colorant and the release agent are optional. It is needless to say that additives other than a colorant and a release agent may be used.

Resin Particle Dispersion Liquid Preparation Step

In addition to a resin particle dispersion liquid in which resin particles serving as a binder resin is dispersed, for example, a colorant particle dispersion liquid in which colorant particles are dispersed and a release-agent particle dispersion liquid in which release-agent particles are dispersed are prepared.

The resin particle dispersion liquid is prepared by, for example, dispersing resin particles in a dispersion medium using a surfactant.

Examples of the dispersion medium used for preparing the resin particle dispersion liquid include aqueous media. Examples of the aqueous media include water, such as distilled water and ion-exchange water; and alcohols. These aqueous media may be used alone or in combination of two or more.

Examples of the surfactant include anionic surfactants, such as sulfate-based surfactants, sulfonate-based surfactants, and phosphate-based surfactants; cationic surfactants, such as amine-salt-based surfactants and quaternary-ammonium-salt-based surfactants; and nonionic surfactants, such as polyethylene-glycol surfactants, alkylphenol-ethylene-oxide-adduct-based surfactants, and polyhydric-alcohol-based surfactants. Among these surfactants, in particular, the anionic surfactants and the cationic surfactants may be used. The nonionic surfactants may be used in combination with the anionic surfactants and the cationic surfactants. These surfactants may be used alone or in combination of two or more.

In the preparation of the resin particle dispersion liquid, the resin particles can be dispersed in a dispersion medium by any suitable dispersion method commonly used in the related art in which, for example, a rotary-shearing homogenizer, a ball mill, a sand mill, or a dyno mill that includes media is used. Depending on the type of the resin particles used, the resin particles may be dispersed in the dispersion medium by, for example, phase-inversion emulsification. Phase-inversion emulsification is a method in which the resin to be dispersed is dissolved in a hydrophobic organic solvent in which the resin is soluble, a base is added to the resulting organic continuous phase (i.e., O phase) to perform neutralization, and subsequently an aqueous medium (i.e., W phase) is charged in order to perform phase inversion from W/O to O/W and disperse the resin in the aqueous medium in the form of particles.

The volume-average diameter of the resin particles dispersed in the resin particle dispersion liquid is preferably, for example, 0.01 μm or more and 1 μm or less, is more preferably 0.08 μm or more and 0.8 μm or less, and is further preferably 0.1 μm or more and 0.6 μm or less.

The volume-average diameter of the resin particles is determined in the following manner. The particle diameter distribution of the resin particles is obtained using a laser-diffraction-type particle-size-distribution measurement apparatus (e.g., "LA-700" produced by HORIBA, Ltd.). The particle diameter distribution measured is divided into a number of particle diameter ranges (i.e., channels). For each range, in ascending order in terms of particle diameter, the cumulative volume is calculated and plotted to draw a cumulative distribution curve. A particle diameter at which the cumulative volume reaches 50% is considered to be the volume particle diameter D50v. The volume-average diameters of particles included in the other dispersion liquids are also determined in the above-described manner.

The content of the resin particles included in the resin particle dispersion liquid is preferably 5% by mass or more and 50% by mass or less and is more preferably 10% by mass or more and 40% by mass or less.

The colorant particle dispersion liquid, the release-agent particle dispersion liquid, and the like are also prepared as in the preparation of the resin particle dispersion liquid. In other words, the above-described specifications for the volume-average diameter of the particles included in the resin particle dispersion liquid, the dispersion medium of the resin particle dispersion liquid, the dispersion method used for preparing the resin particle dispersion liquid, and the content of the particles in the resin particle dispersion liquid can also be applied to colorant particles dispersed in the colorant particle dispersion liquid and release-agent particles dispersed in the release-agent particle dispersion liquid.

Aggregated Particle Formation Step

The resin particle dispersion liquid is mixed with the colorant particle dispersion liquid and the release-agent particle dispersion liquid.

In the resulting mixed dispersion liquid, heteroaggregation of the resin particles with the colorant particles and the release-agent particles is performed in order to form aggregated particles including the resin particles, the colorant particles, and the release-agent particles, the aggregated particles having a diameter close to that of the desired toner particles.

Specifically, for example, a flocculant is added to the mixed dispersion liquid, and the pH of the mixed dispersion liquid is controlled to be acidic (e.g., pH of 2 or more and 5 or less). A dispersion stabilizer may be added to the mixed dispersion liquid as needed. Subsequently, the mixed dispersion liquid is heated to a temperature close to the glass transition temperature of the resin particles (specifically, e.g., [glass transition temperature of the resin particles−30° C.] or more and [the glass transition temperature−10° C.] or less), and thereby the particles dispersed in the mixed dispersion liquid are caused to aggregate together to form aggregated particles.

In the aggregated particle formation step, alternatively, for example, the above flocculant may be added to the mixed dispersion liquid at room temperature (e.g., 25° C.) while the mixed dispersion liquid is stirred using a rotary-shearing homogenizer. Then, the pH of the mixed dispersion liquid is controlled to be acidic (e.g., pH of 2 or more and 5 or less), and a dispersion stabilizer may be added to the mixed dispersion liquid as needed. Subsequently, the mixed dispersion liquid is heated in the above-described manner.

Examples of the flocculant include surfactants, inorganic metal salts, and divalent or higher metal complexes that have a polarity opposite to that of the surfactant included in the mixed dispersion liquid. Using a metal complex as a flocculant reduces the amount of surfactant used and, as a result, charging characteristics may be enhanced.

An additive capable of forming a complex or a bond similar to a complex with the metal ions contained in the flocculant may optionally be used in combination with the flocculant. An example of the additive is a chelating agent.

Examples of the inorganic metal salts include metal salts, such as calcium chloride, calcium nitrate, barium chloride, magnesium chloride, zinc chloride, aluminium chloride, and aluminium sulfate; and inorganic metal salt polymers, such as polyaluminium chloride, polyaluminium hydroxide, and calcium polysulfide.

The chelating agent may be a water-soluble chelating agent. Examples of such a chelating agent include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

The amount of the chelating agent used is preferably 0.01 parts by mass or more and 5.0 parts by mass or less and is more preferably 0.1 parts by mass or more and less than 3.0 parts by mass relative to 100 parts by mass of the resin particles.

Fusion-Coalescence Step

The aggregated particle dispersion liquid in which the aggregated particles are dispersed is heated to, for example, the glass transition temperature of the resin particles or more (e.g., temperature higher than the glass transition temperature of the resin particles by 10° C. to 30° C.) in order to perform fusion and coalescence of the aggregated particles. Hereby, toner particles are prepared.

The toner particles are prepared through the above-described steps.

It is also possible to prepare the toner particles by, after preparing the aggregated particle dispersion liquid in which the aggregated particles are dispersed, further mixing the aggregated particle dispersion liquid with a resin particle dispersion liquid in which resin particles are dispersed and subsequently performing aggregation such that the resin particles are deposited on the surfaces of the aggregated particles in order to form second aggregated particles; and by heating the resulting second-aggregated particle dispersion liquid in which the second aggregated particles are dispersed and thereby causing fusion and coalescence of the second aggregated particles to occur in order to form toner particles having a core-shell structure.

After the completion of the fusion-coalescence step, the toner particles formed in the solution are subjected to any suitable cleaning step, solid-liquid separation step, and drying step that are known in the related art in order to obtain dried toner particles. In the cleaning step, the toner particles may be subjected to displacement washing using ion-exchange water to a sufficient degree from the viewpoint of electrification characteristics. Examples of a solid-liquid separation method used in the solid-liquid separation step include suction filtration and pressure filtration from the viewpoint of productivity. Examples of a drying method used in the drying step include freeze-drying, flash drying, fluidized drying, and vibrating fluidized drying from the viewpoint of productivity.

The toner according to the exemplary embodiment is produced by, for example, adding an external additive to the dried toner particles and mixing the resulting toner particles using a V-blender, a Henschel mixer, a Lodige mixer, or the like. Optionally, coarse toner particles may be removed using a vibrating screen classifier, a wind screen classifier, or the like.

Electrostatic-Image Developer

The electrostatic-image developer according to an exemplary embodiment includes at least the toner according to the above-described exemplary embodiment.

The electrostatic-image developer according to the exemplary embodiment may be a monocomponent developer including only the above-described toner or may be a two-component developer that is a mixture of the above-described toner and a carrier.

The type of the carrier is not limited, and any suitable carrier known in the related art may be used. Examples of the carrier include a coated carrier prepared by coating the surfaces of cores including magnetic powder particles with a resin; a magnetic-powder-dispersed carrier prepared by dispersing and mixing magnetic powder particles in a matrix resin; and a resin-impregnated carrier prepared by impregnating a porous magnetic powder with a resin.

The magnetic-powder-dispersed carrier and the resin-impregnated carrier may also be prepared by coating the surfaces of particles constituting the carrier, that is, core particles, with a resin.

Examples of the magnetic powder include powders of magnetic metals, such as iron, nickel, and cobalt; and powders of magnetic oxides, such as ferrite and magnetite.

Examples of the coat resin and the matrix resin include polyethylene, polypropylene, polystyrene, poly(vinyl acetate), poly(vinyl alcohol), poly(vinyl butyral), poly(vinyl chloride), poly(vinyl ether), poly(vinyl ketone), a vinyl chloride-vinyl acetate copolymer, a styrene-acrylic acid ester copolymer, a straight silicone resin including an organosiloxane bond and the modified products thereof, a fluorine resin, polyester, polycarbonate, a phenolic resin, and an epoxy resin. The coat resin and the matrix resin may optionally include additives, such as conductive particles. Examples of the conductive particles include particles of metals, such as gold, silver, and copper; and particles of carbon black, titanium oxide, zinc oxide, tin oxide, barium sulfate, aluminium borate, and potassium titanate.

The surfaces of the cores can be coated with a resin by, for example, using a coating-layer forming solution prepared by dissolving the coat resin and, as needed, various types of additives in a suitable solvent. The type of the solvent is not limited and may be selected with consideration of the type of the resin used, ease of applying the coating-layer forming solution, and the like.

Specific examples of a method for coating the surfaces of the cores with the coat resin include an immersion method in which the cores are immersed in the coating-layer forming solution; a spray method in which the coating-layer forming solution is sprayed onto the surfaces of the cores; a fluidized-bed method in which the coating-layer forming solution is sprayed onto the surfaces of the cores while the cores are floated using flowing air; and a kneader-coater method in which the cores of the carrier are mixed with the coating-layer forming solution in a kneader coater and subsequently the solvent is removed.

The mixing ratio (i.e., mass ratio) of the toner to the carrier in the two-component developer is preferably toner: carrier=1:100 to 30:100 and is more preferably 3:100 to 20:100.

Image Forming Apparatus and Image Forming Method

The image forming apparatus and the image forming method according to an exemplary embodiment are described below.

The image forming apparatus according to the exemplary embodiment includes an image holding member; a charging unit that charges the surface of the image holding member; an electrostatic-image formation unit that forms an electrostatic image on the surface of the image holding member charged; a developing unit that includes an electrostatic-image developer and develops the electrostatic image formed on the surface of the image holding member using the electrostatic-image developer to form a toner image; a transfer unit that transfers the toner image formed on the surface of the image holding member onto the surface of a recording medium; and a fixing unit that fixes the toner image onto the surface of the recording medium. The electrostatic-image developer according to the above-described exemplary embodiment is used as an electrostatic-image developer.

The image forming apparatus according to the exemplary embodiment uses an image forming method (image forming method according to the exemplary embodiment) including charging the surface of the image holding member; forming an electrostatic image on the surface of the charged image holding member; developing the electrostatic image formed on the surface of the image holding member using the electrostatic-image developer according to the above-described exemplary embodiment to form a toner image; transferring the toner image formed on the surface of the image holding member onto the surface of a recording medium; and fixing the toner image onto the surface of the recording medium.

The image forming apparatus according to the exemplary embodiment may be any image forming apparatus known in the related art, such as a direct-transfer-type image forming apparatus in which a toner image formed on the surface of the image holding member is directly transferred to a recording medium; an intermediate-transfer-type image forming apparatus in which a toner image formed on the surface of the image holding member is transferred onto the surface of the intermediate transfer body in the first transfer step and the toner image transferred on the surface of the intermediate transfer body is again transferred onto the surface of a recording medium in the second transfer step; an image forming apparatus including a cleaning unit that cleans the surface of the image holding member subsequent to transfer of the toner image before the image holding member is again charged; and an image forming apparatus including a static-eliminating unit that eliminates static by irradiating, after the toner image has been transferred, the surface of the image holding member to be again charged with static-eliminating light.

In the case where the image forming apparatus according to the exemplary embodiment is the intermediate-transfer-type image forming apparatus, the transfer unit may be constituted by, for example, an intermediate transfer body to which a toner image is transferred, a first transfer subunit that transfers a toner image formed on the surface of the image holding member onto the surface of the intermediate transfer body in the first transfer step, and a second transfer subunit that transfers the toner image transferred on the surface of the intermediate transfer body onto the surface of a recording medium in the second transfer step.

In the image forming apparatus according to the exemplary embodiment, for example, a portion including the developing unit may have a cartridge structure (i.e., process cartridge) detachably attachable to the image forming apparatus. An example of the process cartridge is a process cartridge including a developing unit and the electrostatic-image developer according to the above-described exemplary embodiment.

An example of the image forming apparatus according to the exemplary embodiment is described below, but the image forming apparatus is not limited thereto. Hereinafter, only components illustrated in drawings are described; others are omitted.

FIG. 1 schematically illustrates the image forming apparatus according to the exemplary embodiment.

The image forming apparatus illustrated in FIG. 1 includes first to fourth electrophotographic image formation units 10Y, 10M, 10C, and 10K that form yellow (Y), magenta (M), cyan (C), and black (K) images, respectively, on the basis of color separation image data. The image formation units (hereafter, referred to simply as "units") 10Y, 10M, 10C, and 10K are horizontally arranged in parallel at a predetermined distance from one another. The units 10Y, 10M, 10C, and 10K may be process cartridges detachably attachable to the image forming apparatus.

An intermediate transfer belt (example of the intermediate transfer body) 20 runs above and extends over the units 10Y, 10M, 10C, and 10K. The intermediate transfer belt 20 is wound around a drive roller 22 and a support roller 24 and runs clockwise in FIG. 1, i.e., in the direction from the first unit 10Y to the fourth unit 10K. Using a spring or the like (not illustrated), a force is applied to the support roller 24 in a direction away from the drive roller 22, thereby applying tension to the intermediate transfer belt 20 wound around the drive roller 22 and the support roller 24. An intermediate transfer body-cleaning device 30 is disposed so as to come into contact with the image-carrier-side surface of the intermediate transfer belt 20 and to face the drive roller 22.

Developing devices (i.e., examples of the developing units) 4Y, 4M, 4C, and 4K of units 10Y, 10M, 10C, and 10K are supplied with yellow, magenta, cyan, and black toners stored in toner cartridges 8Y, 8M, 8C, and 8K, respectively.

Since the first to fourth units 10Y, 10M, 10C, and 10K have the same structure and the same action, the following description is made with reference to, as a representative, the first unit 10Y that forms an yellow image and is located upstream in a direction in which the intermediate transfer belt runs.

The first unit 10Y includes a photosensitive member 1Y serving as an image holding member. The following components are disposed around the photosensitive member 1Y sequentially in the counterclockwise direction: a charging roller (example of the charging unit) 2Y that charges the surface of the photosensitive member 1Y at a predetermined potential; an exposure device (example of the electrostatic-image formation unit) 3 that forms an electrostatic image by irradiating the charged surface of the photosensitive member 1Y with a laser beam 3Y based on a color separated image signal; a developing device (example of the developing unit) 4Y that develops the electrostatic image by supplying a charged toner to the electrostatic image; a first transfer roller (example of the first transfer subunit) 5Y that transfers the developed toner image to the intermediate transfer belt 20; and a photosensitive-member cleaning device (example of the cleaning unit) 6Y that removes a toner remaining on the surface of the photosensitive member 1Y after the first transfer.

The first transfer roller 5Y is disposed so as to be in contact with the inner surface of the intermediate transfer belt 20 and to face the photosensitive member 1Y. Each of the first transfer rollers 5Y, 5M, 5C, and 5K of the respective units is connected to a bias power supply (not illustrated) that applies a first transfer bias to the first transfer rollers. Each bias power supply varies the transfer bias applied to the corresponding first transfer roller on the basis of the control by a controller (not illustrated).

The action of forming a yellow image in the first unit 10Y is described below.

Before the action starts, the surface of the photosensitive member 1Y is charged at a potential of −600 to −800 V by the charging roller 2Y.

The photosensitive member 1Y is formed by stacking a photosensitive layer on a conductive substrate (e.g., volume resistivity at 20° C.: $1\times10^{-6}$ Ωcm or less). The photosensitive layer is normally of high resistance (comparable with the resistance of ordinary resins), but, upon being irradiated with the laser beam, the specific resistance of the portion irradiated with the laser beam varies. Thus, the exposure device 3 irradiates the surface of the charged photosensitive member 1Y with the laser beam 3Y on the basis of the image data of the yellow image sent from the controller (not illustrated). As a result, an electrostatic image of yellow image pattern is formed on the surface of the photosensitive member 1Y.

The term "electrostatic image" used herein refers to an image formed on the surface of the photosensitive member 1Y by charging, the image being a "negative latent image" formed by irradiating a portion of the photosensitive layer with the laser beam 3Y to reduce the specific resistance of the irradiated portion such that the charges on the irradiated surface of the photosensitive member 1Y discharge while the charges on the portion that is not irradiated with the laser beam 3Y remain.

The electrostatic image, which is formed on the photosensitive member 1Y as described above, is sent to the predetermined developing position by the rotating photosensitive member 1Y. The electrostatic image on the photosensitive member 1Y is developed and visualized in the form of a toner image by the developing device 4Y at the developing position.

The developing device 4Y includes an electrostatic-image developer including, for example, at least, a yellow toner and a carrier. The yellow toner is stirred in the developing device 4Y to be charged by friction and supported on a developer roller (example of the developer support), carrying an electric charge of the same polarity (i.e., negative) as the electric charge generated on the photosensitive member 1Y. The yellow toner is electrostatically adhered to the eliminated latent image portion on the surface of the photosensitive member 1Y as the surface of the photosensitive member 1Y passes through the developing device 4Y. Thus, the latent image is developed using the yellow toner. The photosensitive member 1Y on which the yellow toner image is formed keeps rotating at the predetermined rate, thereby transporting the toner image developed on the photosensitive member 1Y to the predetermined first transfer position.

Upon the yellow toner image on the photosensitive member 1Y reaching the first transfer position, first transfer bias is applied to the first transfer roller 5Y so as to generate an electrostatic force on the toner image in the direction from the photosensitive member 1Y toward the first transfer roller 5Y. Thus, the toner image on the photosensitive member 1Y is transferred to the intermediate transfer belt 20. The transfer bias applied has the opposite polarity (+) to that of the toner (−) and controlled to be, in the first unit 10Y, for example, +10 μA by a controller (not illustrated).

The toner remaining on the photosensitive member 1Y is removed by the photosensitive-member cleaning device 6Y and then collected.

Each of the first transfer biases applied to first transfer rollers 5M, 5C, and 5K of the second, third, and fourth units 10M, 10C, and 10K is controlled in accordance with the first unit 10Y.

Thus, the intermediate transfer belt 20, on which the yellow toner image is transferred in the first unit 10Y, is successively transported through the second to fourth units 10M, 10C, and 10K while toner images of the respective colors are stacked on top of another.

The resulting intermediate transfer belt 20 on which toner images of four colors are multiple-transferred in the first to fourth units is then transported to a second transfer section including a support roller 24 being in contact with the inner surface of the intermediate transfer belt 20 and a second transfer roller (example of the second transfer subunit) 26 disposed on the image-carrier-side of the intermediate transfer belt 20. A recording paper (example of the recording medium) P is fed by a feed mechanism into a narrow space between the second transfer roller 26 and the intermediate transfer belt 20 that are brought into contact with each other at the predetermined timing. The second transfer bias is then applied to the support roller 24. The transfer bias applied here has the same polarity (−) as that of the toner (−) and generates an electrostatic force on the toner image in the direction from the intermediate transfer belt 20 toward the recording paper P. Thus, the toner image on the intermediate transfer belt 20 is transferred to the recording paper P. The intensity of the second transfer bias applied is determined on the basis of the resistance of the second transfer section which is detected by a resistance detector (not illustrated) that detects the resistance of the second transfer section and controlled by changing voltage.

Subsequently, the recording paper P is transported into a nip part of the fixing device (example of the fixing unit) 28 at which a pair of fixing rollers are brought into contact with each other. The toner image is fixed to the recording paper P to form a fixed image.

Examples of the recording paper P to which a toner image is transferred include plain paper used in electrophotographic copiers, printers, and the like. Instead of the recording paper P, OHP films and the like may be used as a recording medium.

The surface of the recording paper P may be smooth in order to enhance the smoothness of the surface of the fixed image. Examples of such a recording paper include coated paper produced by coating the surface of plain paper with resin or the like and art paper for printing.

The recording paper P, to which the color image has been fixed, is transported toward an exit portion. Thus, the series of the steps for forming a color image are terminated.

Process Cartridge and Toner Cartridge

The process cartridge according to an exemplary embodiment is described below.

The process cartridge according to the exemplary embodiment includes a developing unit that includes the electrostatic-image developer according to the above-described exemplary embodiment and develops an electrostatic image formed on the surface of an image holding member using the electrostatic-image developer to form a toner image. The process cartridge according to the exemplary embodiment is detachably attachable to an image forming apparatus.

The structure of the process cartridge according to the exemplary embodiment is not limited to the above-described one. The process cartridge according to the exemplary embodiment may further include, in addition to the developing unit, at least one unit selected from an image holding member, a charging unit, an electrostatic-image formation unit, a transfer unit, and the like as needed.

An example of the process cartridge according to the exemplary embodiment is described below, but the process cartridge is not limited thereto. Hereinafter, only components illustrated in FIG. 2 are described; others are omitted.

Figure 2:
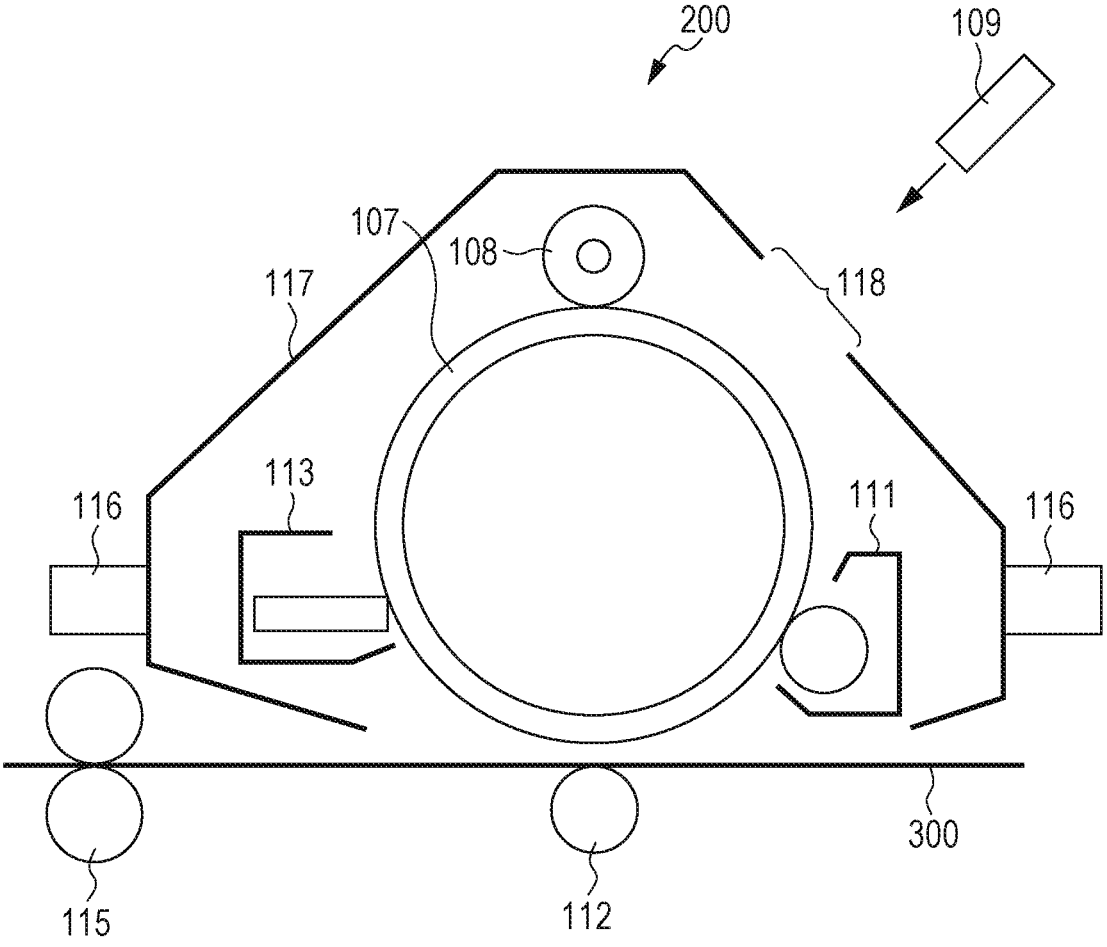
FIG. 2 is a schematic diagram illustrating an example of a process cartridge detachably attachable to an image forming apparatus according to an exemplary embodiment.

FIG. 2 schematically illustrates the process cartridge according to the exemplary embodiment.

A process cartridge 200 illustrated in FIG. 2 includes, for example, a photosensitive member 107 (example of the image holding member), a charging roller 108 (example of the charging unit) disposed on the periphery of the photosensitive member 107, a developing device 111 (example of the developing unit), and a photosensitive-member-cleaning device 113 (example of the cleaning unit), which are combined into one unit using a housing 117 to form a cartridge. The housing 117 has an aperture 118 for exposure. A mounting rail 116 is disposed on the housing 117.

In FIG. 2, Reference numeral 109 denotes an exposure device (example of the electrostatic-image formation unit), Reference numeral 112 denotes a transfer device (example of the transfer unit), Reference numeral 115 denotes a fixing device (example of the fixing unit), and the Reference numeral 300 denotes recording paper (example of the recording medium).

The toner cartridge according to an exemplary embodiment is described below.

The toner cartridge according to the exemplary embodiment includes the toner according to the above-described exemplary embodiment and is detachably attachable to an image forming apparatus. The toner cartridge includes a toner that is to be supplied to a developing unit disposed inside an image forming apparatus.

The image forming apparatus illustrated in FIG. 1 is an image forming apparatus that includes the toner cartridges 8Y, 8M, 8C, and 8K detachably attached to the image forming apparatus. Each of the developing devices 4Y, 4M, 4C, and 4K is connected to a specific one of the toner cartridges which corresponds to the developing device (color) with a toner feed pipe (not illustrated). When the amount of toner contained in a toner cartridge is small, the toner cartridge is replaced.

EXAMPLES

The exemplary embodiments of the present disclosure are described below in detail with reference to Examples below. The exemplary embodiments of the present disclosure are not limited to Examples below. Hereinafter, the expression "parts" means "parts by mass" unless otherwise specified.

Preparation of Toner Particles (1)

Preparation of Polyester Resin Particle Dispersion Liquid (1)

Ethylene glycol (produced by Wako Pure Chemical Industries, Ltd.): 37 parts

Neopentyl glycol (produced by Wako Pure Chemical Industries, Ltd.): 65 parts 1,9-Nonanediol (produced by Wako Pure Chemical Industries, Ltd.): 32 parts Terephthalic acid (produced by Wako Pure Chemical Industries, Ltd.): 96 parts The above materials are charged into a flask and heated to 200° C. over 1 hour. After it has been confirmed that the inside of the reaction system has been stirred, 1.2 parts of dibutyltin oxide is charged into the flask. While the product water is removed by distillation, the temperature is increased from 200° C. to 240° C. over 6 hours and a dehydration condensation reaction is continued for 4 hours at 240° C. Hereby, a polyester resin (1) having an acid value of 9.4 mgKOH/g, a weight-average molecular weight of 13,000, and a glass transition temperature of 62° C. is prepared.

While the polyester resin (1) is in a molten state, the polyester resin (1) is transferred to a "CAVITRON CD1010" produced by EUROTEC at a rate of 100 parts/min. A 0.37%-dilute ammonia water prepared separately is also transferred to the CAVITRON CD1010 at a rate of 0.1 L/min while being heated to 120° C. with a heat exchanger. The CAVITRON CD1010 is operated with a rotor rotation speed of 60 Hz and a pressure of 5 kg/cm$^2$. Hereby, a polyester resin particle dispersion liquid (1) having a solid content of 30% by mass is prepared. The volume-average size of the resin particles included in the polyester resin particle dispersion liquid (1) is 160 nm.

Preparation of Colorant Particle Dispersion Liquid (1)

Cyan pigment (copper phthalocyanine, C.I. Pigment blue 15:3, produced by Dainichiseika Color & Chemicals Mfg. Co., Ltd.): 10 parts Anionic surfactant (NEOGEN SC, produced by DKS Co. Ltd.): 2 parts Ion-exchange water: 80 parts The above materials are mixed with one another. The resulting mixture is subjected to a dispersion treatment using a high-pressure-impact-type disperser Ultimaizer "HJP30006" produced by Sugino Machine Limited for 1 hour to form a colorant particle dispersion liquid (1) having a solid content of 20% by mass. The volume-average size of the colorant particles included in the colorant particle dispersion liquid (1) is 180 nm.

Preparation of Release-Agent Particle Dispersion Liquid (1)

Carnauba wax (RC-160, melting temperature: 84° C., produced by TOA KASEI Co., Ltd.): 50 parts Anionic surfactant (NEOGEN SC, produced by DKS Co. Ltd.): 2 parts Ion-exchange water: 200 parts The above materials are heated to 120° C. and subjected to a dispersion treatment using an ULTRA-TURRAX T50 produced by IKA. Subsequently, a dispersion treatment is performed using a pressure-discharge-type Gaulin homogenizer. Hereby, a release-agent particle dispersion liquid (1) having a solid content of 20% by mass is prepared. The volume-average size of the release-agent particles included in the release-agent particle dispersion liquid (1) is 200 nm.

Preparation of Toner Particles

Polyester resin particle dispersion liquid (1): 200 parts

Colorant particle dispersion liquid (1): 25 parts

Release-agent particle dispersion liquid (1): 30 parts

Polyaluminum chloride: 0.4 parts

Ion-exchange water: 100 parts

The above materials are charged into a stainless steel flask and subjected to a dispersion treatment using an ULTRA-TURRAX produced by IKA. Subsequently, the stainless steel flask is heated to 48° C. while the contents of the flask are stirred in an oil bath for heating. After holding has been performed at 48° C. for 30 minutes, 70 parts of the polyester resin particle dispersion liquid (1) is added to the flask.

After the pH of the system has been adjusted to be 8.0 using an aqueous sodium hydroxide solution having a concentration of 0.5 mol/L, the stainless steel flask is hermetically sealed and the stirrer shaft is magnetically sealed. While stirring is continued, the flask is heated to 90° C. and held for 3 hours. Subsequently, cooling is performed at a cooling rate of 2° C./min. Subsequent to filtration and cleaning with ion-exchange water, solid-liquid separation is performed by Nutsche suction filtration. The resulting solid component is again dispersed in ion-exchange water having a temperature of 30° C. The resulting dispersion liquid is stirred at a rotation speed of 300 rpm for 15 minutes in order to perform cleaning. This cleaning operation is further performed six times. When the pH of the filtrate reaches 7.54 and the electric conductivity of the filtrate reaches 6.5 μS/cm, solid-liquid separation is performed by Nutsche suction filtration using a filter paper. The resulting solid component is vacuum-dried to form toner particles (1). The volume-average size of the toner particles (1) is 5.8 μm.

Preparation of Hydrophobic Silica Particles (1)

Silica Particle Formation Step

Into a glass reaction container equipped with a stirrer, a dropping nozzle, and a thermometer, 300 parts of methanol and 70 parts of 10% ammonia water are charged. The above materials are mixed with each other to form an alkali catalyst solution. After the temperature of the alkali catalyst solution has been adjusted to be 30° C., 60 parts of tetramethoxysilane (TMOS) and 1.7 parts of 10% ammonia water are added to the reaction container while the alkali catalyst solution is stirred. Hereby, a silica particle dispersion liquid is prepared. The addition of the TMOS and the addition of the 10% ammonia water are started at the same time. It takes 3 minutes to add the whole amounts of the TMOS and the 10% ammonia water dropwise to the reaction container. The silica particle dispersion liquid is concentrated using a rotary filter "R-fine" produced by Kotobuki Industries Co., Ltd. until the concentration of the solid component reaches 40% by mass. The concentrated silica particle dispersion liquid is used as a silica particle dispersion liquid (1).

Silica Particle Surface Treatment Step

To 250 parts of the silica particle dispersion liquid (1), 100 parts of hexamethyldisilazane (HMDS) that serves as a hydrophobizing agent is added. After the resulting mixture has been heated to 130° C. to react for 2 hours, drying is performed under the drying conditions described in Table 1. Hereby, hydrophobic silica particles (S1) are prepared. Subsequently, tetrakis(trimethylsiloxy)silane is prepared in an amount that is 0.020% by mass of the amount of the silica particle dispersion liquid (1). The tetrakis(trimethylsiloxy) silane is diluted 5 times with methanol and then added to the hydrophobic silica particles (S1). Subsequently, drying is performed while the inside of the reaction system is stirred at 80° C. Hereby, hydrophobic silica particles (1) are prepared.

Preparation of Hydrophobic Silica Particles (2) to (8) and Hydrophobic Silica Particles (C1) and (C2)

Hydrophobic silica particles are prepared as in the preparation of the silica particles (1), except that the type of the low-molecular-weight siloxane used in the silica particle surface treatment step is changed as described in Table 1.

Preparation of Hydrophobic Silica Particles (9) to (12) and Hydrophobic Silica Particles (C3) and (C4)

Hydrophobic silica particles are prepared as in the preparation of the silica particles (1), except that the amount of the low-molecular-weight siloxane used in the silica particle surface treatment step is changed as described in Table 1.

Preparation of Hydrophobic Silica Particles (13) to (16)

Hydrophobic silica particles are prepared as in the preparation of the silica particles (1), except that the silica particle formation step is changed as described in Table 1.

Preparation of Hydrophobic Silica Particles (17) to (20)

Hydrophobic silica particles are prepared as in the preparation of the silica particles (1), except that the conditions under which drying is performed in the silica particle surface treatment step are changed as described in Table 1.

Preparation of Carrier

Ferrite particles (volume-average size: 36 μm): 100 parts

Toluene: 14 parts

Styrene-methyl methacrylate copolymer: 2 parts (polymerization mass ratio: 90:10, weight-average molecular weight: 80,000)

Carbon black "R330" produced by Cabot Corporation: 0.2 parts

Toluene, the styrene-methyl methacrylate copolymer, and carbon black are mixed with one another, and the resulting mixture is stirred with a stirrer for 10 minutes to form a dispersion liquid. The dispersion liquid and the ferrite particles are charged into a vacuum degassing kneader and then stirred at 60° C. for 30 minutes. While heating is performed, the pressure is reduced to perform degassing. Subsequently, drying is performed. Hereby, a carrier is prepared.

Example 1

The toner particles (1) and the hydrophobic silica particles (1) are charged into a Henschel mixer at proportions of Toner particle (1):Hydrophobic silica particles (1)=99:1 (by mass). The resulting mixture is stirred at a peripheral speed of 30 m/sec for 15 minutes. Hereby, a toner including an external additive deposited thereon is prepared.

The above toner and the carrier are charged into a V-blender at proportions of Toner:Carrier=10:100 (by mass), and the resulting mixture is stirred for 20 minutes to form a developer.

Examples 2 to 20 and Comparative Examples 1 to 4

A toner including an external additive deposited thereon and a developer are prepared as in Example 1, except that the type of the hydrophobic silica particles used is changed as described in Table 2.

Performance Evaluations

Initial Rise in Charge

The developer is left to stand in an environment of 28° C. and 85% relative humidity for 24 hours in order to perform air conditioning. In this environment, 7.5 g of the developer is charged into a tumbler mixer and stirred. The amount of charge (μC/g) stored on the developer after stirring has been performed for 10 second is measured with a blow-off charge measurement system. This value is considered as the initial amount of charge. The developer is further stirred for another 10 minutes. The amount of charge (μC/g) stored on the developer after the 10 minutes stirring is measured with a blow-off charge measurement system. This value is considered as the amount of charge at saturation. The proportion (%) of the initial amount of charge to the amount of charge at saturation, that is, [Initial amount of charge]/[Amount of charge at saturation]×100, is calculated and evaluated as "A" to "E" as described below. Samples evaluated as "A" to "C" are considered acceptable. Table 2 describes the evaluation results.

A: 95% or more

B: 90% or more and less than 95%

C: 85% or more and less than 90%

D: 80% or more and less than 85%

E: Less than 80%

Fog

The developer is charged into an image forming apparatus that is a modification of DocuCenterColor400 produced by Fuji Xerox Co., Ltd and left to stand in an environment of 28° C. and 85% relative humidity for 24 hours in order to perform air conditioning. In this environment, Test Chart No. 1 produced by The Imaging Society of Japan is formed on ten A4-size plain paper sheets "C2 paper" produced by Fuji Xerox Co., Ltd. The background of the third image is inspected by the naked eye and a loupe with a magnification of 20 times. Samples are evaluated as "A" to "E" as described below. Samples evaluated as "A" to "C" are considered acceptable. Table 2 describes the evaluation results.

A: Occurrence of fog is not confirmed by the naked eye or the loupe.

B: Occurrence of fog is not confirmed by the naked eye, but 1 to 9 toner particles per square millimeter are confirmed at some positions by the loupe.

C: Occurrence of fog is not confirmed by the naked eye, but 10 or more toner particles per square millimeter are confirmed at some positions by the loupe.

D: Occurrence of fog is slightly confirmed by the naked eye.

E: Occurrence of fog is clearly confirmed by the naked eye.

TABLE 1

| | Formation of silica particles | | | | | | | | | | | | | | |
|---|---|---|---|---|---|---|---|---|---|---|---|---|---|---|---|
| | | | Particle formation conditions | | | | | | | | | | | | |
| | | | | Total amount of ammonia water added mass part | | Surface treatment of silica particles | | | | | | | | | |
| | Alkali catalyst solution | | Total amount of TMOS added mass part | | | | | | Low-molecular-weight siloxane | | | | | Hydrophobic silica particles | |
| | | | | | | | Drying conditions | | | | | | | | |
| No. | MeOH mass part | Ammonia water mass part | | | Addition time minute | Hydrophobizing agent — | Drying temperature ° C. | Drying time minute | Name of chemical substance — | Molecular structure — | Molecular weight — | Kinematic viscosity (25° C.) $mm^2/s$ | Proportion to silica particle dispersion liquid mass % | Average primary particle size nm | Mass reduction due to heating mass % |
| (C1) | 300 | 70 | 60 | 1.7 | 3 | HMDS | 150 | 2 | hexamethyldisiloxane | Linear | 162 | 1 | 0.020 | 45 | 6 |
| (C2) | 300 | 70 | 60 | 1.7 | 3 | HMDS | 150 | 2 | Octadecamethyloctasiloxane | Linear | 607 | 8 | 0.020 | 45 | 3 |
| (1) | 300 | 70 | 60 | 1.7 | 3 | HMDS | 150 | 2 | Tetrakis(trimethylsiloxy)silane | Branched, tetrakis structure | 385 | 3 | 0.020 | 45 | 5 |
| (2) | 300 | 70 | 60 | 1.7 | 3 | HMDS | 150 | 2 | 1,1,1,3,5,5,7,7,7-Nonamethyl-3-(trimethylsiloxy)tetrasiloxane | Branched | 385 | 3 | 0.020 | 45 | 5 |
| (3) | 300 | 70 | 60 | 1.7 | 3 | HMDS | 150 | 2 | Octamethyltrisiloxane | Linear | 237 | 2 | 0.020 | 45 | 6 |
| (4) | 300 | 70 | 60 | 1.7 | 3 | HMDS | 150 | 2 | Decamethyltetrasiloxane | Linear | 311 | 3 | 0.020 | 45 | 5 |
| (5) | 300 | 70 | 60 | 1.7 | 3 | HMDS | 150 | 2 | Tetradecamethylhexasiloxane | Linear | 459 | 4 | 0.020 | 45 | 4 |
| (6) | 300 | 70 | 60 | 1.7 | 3 | HMDS | 150 | 2 | Hexadecamethylheptasiloxane | Linear | 533 | 4 | 0.020 | 45 | 4 |
| (7) | 300 | 70 | 60 | 1.7 | 3 | HMDS | 150 | 2 | Octamethylcyclotetrasiloxane | Cyclic | 297 | 2 | 0.020 | 45 | 5 |
| (8) | 300 | 70 | 60 | 1.7 | 3 | HMDS | 150 | 2 | Dodecamethylcyclohexasiloxane | Cyclic | 445 | 3 | 0.020 | 45 | 4 |
| (C3) | 300 | 70 | 60 | 1.7 | 3 | HMDS | 150 | 2 | — | — | — | — | 0 | 45 | 6 |
| (9) | 300 | 70 | 60 | 1.7 | 3 | HMDS | 150 | 2 | Tetrakis(trimethylsiloxy)silane | Branched, tetrakis structure | 385 | 3 | 0.005 | 45 | 5 |
| (10) | 300 | 70 | 60 | 1.7 | 3 | HMDS | 150 | 2 | Tetrakis(trimethylsiloxy)silane | Branched, tetrakis structure | 385 | 3 | 0.100 | 45 | 5 |
| (11) | 300 | 70 | 60 | 1.7 | 3 | HMDS | 150 | 2 | Tetrakis(trimethylsiloxy)silane | Branched, tetrakis structure | 385 | 3 | 1 | 45 | 5 |
| (12) | 300 | 70 | 60 | 1.7 | 3 | HMDS | 150 | 2 | Tetrakis(trimethylsiloxy)silane | Branched, tetrakis structure | 385 | 3 | 3 | 45 | 5 |
| (C4) | 300 | 70 | 60 | 1.7 | 3 | HMDS | 150 | 2 | Tetrakis(trimethylsiloxy)silane | Branched, tetrakis structure | 385 | 3 | 15 | 45 | 4 |
| (13) | 300 | 70 | 40 | 1.7 | 3 | HMDS | 150 | 2 | Tetrakis(trimethylsiloxy)silane | Branched, tetrakis structure | 385 | 3 | 0.020 | 15 | 7 |
| (14) | 300 | 70 | 50 | 1.7 | 3 | HMDS | 150 | 2 | Tetrakis(trimethylsiloxy)silane | Branched, tetrakis structure | 385 | 3 | 0.020 | 20 | 6 |
| (15) | 300 | 70 | 100 | 1.7 | 3 | HMDS | 150 | 2 | Tetrakis(trimethylsiloxy)silane | Branched, tetrakis structure | 385 | 3 | 0.020 | 90 | 5 |
| (16) | 300 | 70 | 180 | 1.7 | 3 | HMDS | 150 | 2 | Tetrakis(trimethylsiloxy)silane | Branched, tetrakis structure | 385 | 3 | 0.020 | 100 | 4 |
| (17) | 300 | 70 | 60 | 1.7 | 3 | HMDS | 220 | 2 | Tetrakis(trimethylsiloxy)silane | Branched, tetrakis structure | 385 | 3 | 0.020 | 45 | 0.1 |
| (18) | 300 | 70 | 60 | 1.7 | 3 | HMDS | 170 | 2 | Tetrakis(trimethylsiloxy)silane | Branched, tetrakis structure | 385 | 3 | 0.020 | 45 | 1 |
| (19) | 300 | 70 | 60 | 1.7 | 3 | HMDS | 120 | 2 | Tetrakis(trimethylsiloxy)silane | Branched, tetrakis structure | 385 | 3 | 0.020 | 45 | 10 |
| (20) | 300 | 70 | 60 | 1.7 | 3 | HMDS | 70 | 2 | Tetrakis(trimethylsiloxy)silane | Branched, tetrakis structure | 385 | 3 | 0.020 | 45 | 20 |

TABLE 2

| | Hydrophobic silica particles | | | | Low-molecular-weight siloxane | | | | | | Toner performance | |
|---|---|---|---|---|---|---|---|---|---|---|---|---|
| | No. — | Hydrophobizing agent — | Average primary particle size nm | Mass reduction due to heating mass % | Name of chemical substance — | Molecular structure — | Molecular weight — | Kinematic viscosity (25° C.) $mm^2/s$ | Proportion of low-molecular-weight siloxane to toner ppm | Proportion of low-molecular-weight siloxane to hydrophobic silica ppm | Initial rise in charge — | Fog — |
| Comparative example 1 | (C1) | HMDS | 45 | 6 | hexamethyldisiloxane | Linear | 162 | 1 | 0.110 | 11 | E | E |
| Comparative example 2 | (C2) | HMDS | 45 | 3 | Octadecamethyloctasiloxane | Linear | 607 | 8 | 0.120 | 12 | D | D |
| Example 1 | (1) | HMDS | 45 | 5 | Tetrakis(trimethylsiloxy)silane | Branched, tetrakis structure | 385 | 3 | 0.130 | 13 | A | A |
| Example 2 | (2) | HMDS | 45 | 5 | 1,1,1,3,5,5,7,7,7-Nonamethyl-3-(trimethylsiloxy)tetrasiloxane | Branched | 385 | 3 | 0.110 | 11 | B | B |
| Example 3 | (3) | HMDS | 45 | 6 | Octamethyltrisiloxane | Linear | 237 | 2 | 0.120 | 12 | B | B |
| Example 4 | (4) | HMDS | 45 | 5 | Decamethyltetrasiloxane | Linear | 311 | 3 | 0.140 | 14 | B | B |
| Example 5 | (5) | HMDS | 45 | 4 | Tetradecamethylhexasiloxane | Linear | 459 | 4 | 0.130 | 13 | A | A |
| Example 6 | (6) | HMDS | 45 | 4 | Hexadecamethylheptasiloxane | Linear | 533 | 4 | 0.110 | 11 | B | B |
| Example 7 | (7) | HMDS | 45 | 5 | Octamethylcyclotetrasiloxane | Cyclic | 297 | 2 | 0.120 | 12 | C | C |
| Example 8 | (8) | HMDS | 45 | 4 | Dodecamethylcyclohexasiloxane | Cyclic | 445 | 3 | 0.130 | 13 | C | C |
| Comparative example 3 | (C3) | HMDS | 45 | 6 | — | — | — | — | Beyond detection | Beyond detection | E | E |
| Example 9 | (9) | HMDS | 45 | 5 | Tetrakis(trimethylsiloxy)silane | Branched, tetrakis structure | 385 | 3 | 0.032 | 3.2 | C | C |
| Example 10 | (10) | HMDS | 45 | 5 | Tetrakis(trimethylsiloxy)silane | Branched, tetrakis structure | 385 | 3 | 0.480 | 48 | B | B |
| Example 11 | (11) | HMDS | 45 | 5 | Tetrakis(trimethylsiloxy)silane | Branched, tetrakis structure | 385 | 3 | 1.000 | 100 | B | B |
| Example 12 | (12) | HMDS | 45 | 5 | Tetrakis(trimethylsiloxy)silane | Branched, tetrakis structure | 385 | 3 | 3.000 | 300 | C | C |
| Comparative example 4 | (C4) | HMDS | 45 | 4 | Tetrakis(trimethylsiloxy)silane | Branched, tetrakis structure | 385 | 3 | 15.000 | 1500 | D | D |
| Example 13 | (13) | HMDS | 15 | 7 | Tetrakis(trimethylsiloxy)silane | Branched, tetrakis structure | 385 | 3 | 0.160 | 16 | C | C |
| Example 14 | (14) | HMDS | 20 | 6 | Tetrakis(trimethylsiloxy)silane | Branched, tetrakis structure | 385 | 3 | 0.150 | 15 | B | B |
| Example 15 | (15) | HMDS | 90 | 5 | Tetrakis(trimethylsiloxy)silane | Branched, tetrakis structure | 385 | 3 | 0.140 | 14 | B | B |
| Example 16 | (16) | HMDS | 100 | 4 | Tetrakis(trimethylsiloxy)silane | Branched, tetrakis structure | 385 | 3 | 0.130 | 13 | C | C |
| Example 17 | (17) | HMDS | 45 | 0.1 | Tetrakis(trimethylsiloxy)silane | Branched, tetrakis structure | 385 | 3 | 0.130 | 13 | D | D |
| Example 18 | (18) | HMDS | 45 | 1 | Tetrakis(trimethylsiloxy)silane | Branched, tetrakis structure | 385 | 3 | 0.130 | 13 | B | B |
| Example 19 | (19) | HMDS | 45 | 10 | Tetrakis(trimethylsiloxy)silane | Branched, tetrakis structure | 385 | 3 | 0.130 | 13 | C | C |
| Example 20 | (20) | HMDS | 45 | 20 | Tetrakis(trimethylsiloxy)silane | Branched, tetrakis structure | 385 | 3 | 0.130 | 13 | D | D |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic-image developing toner comprising:

toner particles;

inorganic particles externally added to the toner particles; and a low-molecular-weight siloxane having a molecular weight of 200 or more and 600 or less, the low-molecular-weight siloxane consisting of siloxane bonds and alkyl groups, wherein the total content of the low-molecular-weight siloxane in the electrostatic-image developing toner is, by mass, 0.01 ppm or more and 5 ppm or less.

2. The electrostatic-image developing toner according to claim 1, wherein the ratio of the total content of the low-molecular-weight siloxane in the electrostatic-image developing toner to the total content of the inorganic particles in the electrostatic-image developing toner is, by mass, 10 ppm or more and 1,000 ppm or less.

3. The electrostatic-image developing toner according to claim 1, wherein the inorganic particles include sol-gel silica particles having an average primary particle size of 20 nm or more and 90 nm or less.

4. The electrostatic-image developing toner according to claim 1, wherein the inorganic particles include sol-gel silica particles, and wherein a reduction in the mass of the sol-gel silica particles which occurs when the sol-gel silica particles are heated from 30° C. to 250° C. at a rate of 30° C./min is 1% by mass or more and 10% by mass or less.

5. The electrostatic-image developing toner according to claim 1, wherein the low-molecular-weight siloxane includes at least one selected from the group consisting of a linear low-molecular-weight siloxane and a branched low-molecular-weight siloxane.

6. The electrostatic-image developing toner according to claim 1, wherein the low-molecular-weight siloxane includes a low-molecular-weight siloxane having a tetrakis structure.

7. The electrostatic-image developing toner according to claim 1, wherein the low-molecular-weight siloxane includes tetrakis(trimethylsiloxy)silane.

8. An electrostatic-image developer comprising the electrostatic-image developing toner according to claim 1.

9. A process cartridge detachably attachable to an image forming apparatus, the process cartridge comprising the electrostatic-image developer according to claim 8 and a developing unit that develops an electrostatic image formed on a surface of an image holding member with the electrostatic-image developer to form a toner image.

10. An image forming apparatus comprising:

an image holding member;

a charging unit that charges a surface of the image holding member;

an electrostatic-image formation unit that forms an electrostatic image on the charged surface of the image holding member;

a developing unit that includes the electrostatic-image developer according to claim 8 and develops the electrostatic image formed on the surface of the image holding member with the electrostatic-image developer to form a toner image;

a transfer unit that transfers the toner image formed on the surface of the image holding member onto a surface of a recording medium; and a fixing unit that fixes the toner image transferred onto the surface of the recording medium.

11. An image forming method comprising:

charging a surface of an image holding member;

forming an electrostatic image on the charged surface of the image holding member;

developing the electrostatic image formed on the surface of the image holding member with the electrostatic-image developer according to claim 8 to form a toner image;

transferring the toner image formed on the surface of the image holding member onto a surface of a recording medium; and fixing the toner image transferred onto the surface of the recording medium.

12. A toner cartridge detachably attachable to an image forming apparatus, the toner cartridge comprising the electrostatic-image developing toner according to claim 1.

* * * * *